US009781510B2

(12) United States Patent
Brannmark et al.

(10) Patent No.: US 9,781,510 B2
(45) Date of Patent: Oct. 3, 2017

(54) AUDIO PRECOMPENSATION CONTROLLER DESIGN USING A VARIABLE SET OF SUPPORT LOUDSPEAKERS

(75) Inventors: Lars-Johan Brannmark, Uppsala (SE); Anders Ahlen, Knivsta (SE); Adrian Bahne, Uppsala (SE)

(73) Assignee: Dirac Research AB, Uppsala (SE)

( * ) Notice: Subject to any disclaimer, the term of this patent is extended or adjusted under 35 U.S.C. 154(b) by 392 days.

(21) Appl. No.: 14/009,215

(22) PCT Filed: Mar. 22, 2012

(86) PCT No.: PCT/SE2012/050320

§ 371 (c)(1),
(2), (4) Date: Jan. 28, 2014

(87) PCT Pub. No.: WO2013/141768

PCT Pub. Date: Sep. 26, 2013

(65) Prior Publication Data

US 2014/0153744 A1 Jun. 5, 2014

(51) Int. Cl.
*H04R 5/00* (2006.01)
*H04R 3/04* (2006.01)
(Continued)

(52) U.S. Cl.
CPC ..... *H04R 3/04* (2013.01); *H04S 7/301* (2013.01); *H04S 5/00* (2013.01); *H04S 7/305* (2013.01)

(58) Field of Classification Search
CPC . H04R 3/04; H04S 7/301; H04S 7/305; H04S 5/00; H04S 5/005; H04S 5/02
See application file for complete search history.

(56) References Cited

U.S. PATENT DOCUMENTS 7,215,787 B2 5/2007 Sternad et al.
7,720,237 B2 5/2010 Bharitkar et al.
(Continued)

FOREIGN PATENT DOCUMENTS

EP 1355509 A2 10/2003
EP 2104374 A1 9/2009
(Continued)

OTHER PUBLICATIONS

Anderson et al., Optimal Control Linear Quadratic Methods, Solutions Manual, 1990, International Standard Book No. 0-486-45766-4, table of contents, preface/abstract, Prentice-Hall, Inc., New York.
(Continued)

*Primary Examiner* — Duc Nguyen
*Assistant Examiner* — Kile Blair
(74) *Attorney, Agent, or Firm* — The Webb Law Firm

(57) ABSTRACT

Disclosed is a method and a system to determine an audio precompensation controller for an associated sound generating system including a total of N≥2 loudspeakers, each having a loudspeaker input. The audio precompensation controller has a number L≥1 inputs for L input signals and N outputs for N controller output signals, one to each loudspeaker. For each one of at least a subset of the N loudspeaker inputs, an impulse response is estimated at each measurement position. For each one of the L input signal(s), a selected one of the N loudspeakers is specified as a primary loudspeaker and a selected subset S including at least one of the N loudspeakers as support loudspeaker(s).

27 Claims, 11 Drawing Sheets

(51) Int. Cl.
*H04S 7/00* (2006.01)
*H04S 5/00* (2006.01)

(56) References Cited

U.S. PATENT DOCUMENTS

| | | | | |
|---|---|---|---|---|
| 7,742,607 | B2 | 6/2010 | Karjalainen et al. | |
| 2003/0197965 | A1 | 10/2003 | Sternad et al. | |
| 2005/0276420 | A1* | 12/2005 | Davis | H04S 5/005 381/20 |
| 2006/0067535 | A1 | 3/2006 | Culbert et al. | |
| 2010/0290643 | A1 | 11/2010 | Mihelich et al. | |
| 2010/0305725 | A1 | 12/2010 | Brannmark et al. | |
| 2011/0081032 | A1 | 4/2011 | Soulodre | |

FOREIGN PATENT DOCUMENTS

| | | | |
|---|---|---|---|
| EP | 2257083 | A1 | 12/2010 |
| JP | 2004040771 | A | 2/2004 |
| JP | 2005151539 | A | 6/2005 |
| JP | 2012503454 | A | 2/2012 |
| WO | 2011044063 | A2 | 4/2011 |

OTHER PUBLICATIONS

Bauck et al., Generalized Transaural Stereo and Applications, Sep. 1996, vol. 44, Issue 9, pp. 683-705, Journal of the Audio Engineering Society, US.

Brannmark et al., Robust Audio Precompensation with Probabilistic Modeling of Transfer Function Variability, Oct. 18, 2009, pp. 193-196, ISSN. 1931-1168, IEEE Workshop on Applications of Audio and Acoustics, New York.

Brannmark et al., Improved Loudspeaker-Room Equalization using Multiple Loudspeakers and MIMO Feedforward Control, Mar. 25, 2012, pp. 237-240, ISSN. 1520-6149, IEEE International Conference on Acoustics, Speech and Signal Processing, Kyoto, Japan.

Brannmark et al., Spatially Robust Audio Compensation Based on SIMO Feedforward Control, May 2009, pp. 1689-1702, ISSN. 1053-587X, IEEE Transactions on Signal Processing.

Celestinos et al., Controlled Acoustic Bass System (CABS) A Method to Achieve Uniform Sound Field Distribution at Low Frequencies in Rectangular Rooms, Dec. 2008, vol. 56, Issue 11, pp. 915-931, Journal of the Audio Engineering Society.

Celestinos et al., Time Based Room Correction System for Low Frequencies using Multiple Loudspeakers, Sep. 2007, Paper No. 19, Presented at the AES 32nd International Conference: DSP for Loudspeakers, Denmark.

Corteel, Equalization in an Extended Area using Multichannel Equalization and Wave Field Synthesis, Dec. 2006, pp. 1140-1161, vol. 54, Issue 12, Journal of the Audio Engineering Society.

Daniel et al., Further Investigations of High Order Ambisonics and Wavefield Synthesis for Holophonic Sound Imaging, Mar. 2003, Preprint 5788, Presented at AES I 14th Convention, Audio Engineering Society, Amsterdam, Netherlands.

Elliott et al., A Multiple Error LMS Algorithm and its Application to the Active Control of Sound and Vibration, Oct. 1987, pp. 1423-1434, vol. 35, Issue 10, IEEE Transactions on Acoustics, Speech and Signal Processing.

Fazi et al., Surround System Based on Three Dimensional Sound Field Reconstruction, Oct. 2008, Preprint 7555, Presented at AES 125th Convention, Audio Engineering Society, San Francisco, CA.

Fielder, Analysis of Traditional and Reverberation-Reducing Methods of Room Equalization, Feb. 2003, pp. 3-261; vol. 51, Issue 1/2, Journal of the Audio Engineering Society.

Hatziantoniou et al., Errors in Real-Time Room Acoustics Dereverberation, Sep. 2004, pp. 883-899, vol. 52, Issue 9, Journal of the Audio Engineering Society.

Kailath, Linear Systems, 1980, vol. 1, table of contents, preface/abstract, Prentice-Hall, Englewood Cliffs, NJ.

Karjalainen et al., About Room Response Equalization and Dereverberation, Oct. 2005, pp. 183-186, IEEE Workshop on Applications of Signal Processing to Audio and Acoustics, New Paltz, NY.

Kolundzija, et al., Reproducing Sound Fields using MIMO Acoustic Channel Inversion, Oct. 2011, pp. 721-734, vol. 59, Issue 10, Journal of the Audio Engineering Society.

Kucera, Analysis and Design of Discrete Linear Control Systems, 1991, table of contents, preface/abstract, Academia, Prague.

Kwakernaak, et al., Linear Optimal Control Systems, 1972, vol. 1, table of contents, preface/abstract, Wiley, New York.

Makivirta, Modal Equalization of Loudspeaker-Room Responses at Low Frequencies, May 2003, pp. 324-343, vol. 51, Issue 5, Journal of the Audio Engineering Society.

Miyoshi, et al., Inverse Filtering of Room Acoustics, Feb. 1998, pp. 145-152, vol. 36, Issue 2, IEEE Transactions on Acoustics, Speech and Signal Processing.

Neely, et al., Invertibility of a Room Impulse Response, Jul. 1979, pp. 165-169, vol. 66, Issue 1, The Journal of the Acoustical Society of America.

Nelson, et al., Experiments on a System for the Synthesis of Virtual Acoustic Sources, Nov. 1996, pp. 990-1007, vol. 44, Issue 11, Journal of the Audio Engineering Society.

Nelson, et al., Sound Fields for the Production of Virtual Acoustic Images, Jul. 1997, pp. 386-396, vol. 204, Issue 2, Journal of Sound and Vibration.

Ohrn, Design of Multivariable Cautious Discrete-Time Wiener Filters, A Probabilistic Approach PhD Thesis, 1996, partial table of contents, preface/abstract, Uppsala University, Sweden.

Ohrn, et al., A Probabilistic Approach to Multivariable Robust Filtering and Open-Loop Control, IEEE Transactions on Automatic Control, Mar. 1995, pp. 405-418, vol. 40, Issue 3, IEEE Control System Society.

Poletti, Three-Dimensional Surround Sound Systems Based on Spherical Harmonics, Nov. 2005, pp. 1004-1025, vol. 53, Issue 11, Journal of the Audio Engineering Society.

Spors, et al., Active Listening Room Compensation for Massive Multichannel Sound Reproduction Systems Using Wave-Domain Adaptive Filtering, Jul. 2007, pp. 354-369, vol. 122, Issue 1, The Journal of the Acoustical Society of America.

Spors, et al., The Theory of Wave Field Synthesis Revisited, Presented at AES 124th Convention, May 2008, Preprint 7358, Audio Engineering Society, Amsterdam, Netherlands.

Sternad, et al., LQ Controller Design and Self-Tuning Control, , K. Hunt, Editor, Polynomial Methods in Optimal Control and Filtering, 1993, pp. 56-92, Peter Peregrinus, Ltd.

Sternad, et al., Robust Filtering and Feedforward Control Based on Probabilistic Descriptions off Model Errors, 1993, pp. 661-679, vol. 29, Issue 3, Automatica, Great Britain.

Vanderkooy, Multi-Source Room Equalization: Reducing Room Resonances, Presented at AES 123rd Convention, Oct. 2007, Preprint 7262, Audio Engineering Society, New York.

Welti, et al., Low-Frequency Optimization Using Multiple Subwoofers, 2006, pp. 347-364, vol. 54, Issue 5, J. Audio Engineering Society.

* cited by examiner

AUDIO PRECOMPENSATION CONTROLLER DESIGN USING A VARIABLE SET OF SUPPORT LOUDSPEAKERS

TECHNICAL FIELD OF THE INVENTION

The present invention generally concerns digital audio precompensation and more particularly the design of a digital audio precompensation controller that generates several signals to a sound generating system, with the aim of modifying the dynamic response of the compensated system, as measured in several measurement positions in a spatial region of interest in a listening environment.

BACKGROUND OF THE INVENTION

A system for generating or reproducing sound-including amplifiers, cables, loudspeakers and room acoustics-will always affect the spectral, transient and spatial properties of the reproduced sound, often in unwanted ways. In particular, the acoustic reverberation of the room where the equipment is placed has a considerable and often detrimental effect on the perceived audio quality of the system. The effect of reverberation is often described differently depending on which frequency region is considered. At low frequencies, reverberation is often described in terms of resonances, standing waves, or so-called room modes, which affect the reproduced sound by introducing strong peaks and deep nulls at distinct frequencies in the low end of the spectrum. At higher frequencies, reverberation is generally thought of as reflections arriving at the listener's ears some time after the direct sound from the loudspeaker itself.

Sound reproduction with very high quality can generally be obtained by using matched sets of high-quality cables, amplifiers and loudspeakers, and by modifying the acoustic properties of the room using for example acoustic diffusers, Helmholtz resonators and acoustically absorbing materials. However, such passive means for improving sound quality are cumbersome, expensive, and sometimes not even feasible.

Other means for improving the quality of sound reproduction systems include active solutions based on digital filtering, often referred to as precompensation, equalization, or dereverberation.

A precompensation filter, $\mathcal{R}$ in FIG. 1, is then placed between the original audio signal source and the audio equipment. The dynamic properties of the sound generating system can be measured and modeled by recording the system's response to known test signals at one or several positions in the room. The filter $\mathcal{R}$ is then calculated and implemented to compensate for the measured properties of the system, symbolized by $\mathcal{H}$ in FIG. 1. In particular it is desirable that the phase and amplitude response of the compensated system is close to a pre-specified ideal response, symbolized by $\mathcal{D}$ in FIG. 1, in all measurement positions. In other words, it is required that the compensated sound reproduction y(t) matches the ideal $y_{ref}(t)$ to some given degree of accuracy. The pre-distortion generated by the precompensator $\mathcal{R}$ is intended to counteract the distortion due to the system $\mathcal{H}$, such that the resulting sound reproduction has the sound characteristic of $\mathcal{D}$.In order to obtain a precompensator that is robust and practically useful, it is important to realize that the model $\mathcal{H}$ may not be a perfect description of the real system, and the recordings of the system responses may contain disturbances due to e.g., background noise. Such measurement and modeling errors can for example be represented by adding a noise signal, e(t) in FIG. 1 to the system, yielding the measured system output $y_m(t)$. As will be described in the following, modeling errors and uncertainties about the system can also be included in the model $\mathcal{H}$, which is then partly parameterized by random variables with specified probability distributions.

Up to the physical limits of the system, it is thus, at least in theory, possible to attain an improved sound reproduction quality without the high cost of using extreme high-end audio equipment. The aim of the design could, for example, be to cancel acoustic resonances and diffraction effects caused by imperfectly built loudspeaker cabinets. Another application could be to minimize the effect of room modes (i.e., low-frequency resonance peaks and nulls) in different places of the listening room. Yet another aim could be to obtain a pleasant tonal balance and a detailed perceived stereo image.

So far, the established methods for digital precompensation of audio systems that exist on the commercial market and in the scientific literature are mainly single-channel methods, see e.g., [17]. Single-channel precompensation refers to the principle that the input signal to a loudspeaker is processed by a single filter. When single-channel precompensation is applied to a sound system containing more than one loudspeaker channel—for example a 5.1 home cinema system having five wide-band channels and a subwoofer—it means that the filters for different loudspeaker channels are determined individually and independently of each other. The extent to which each compensated loudspeaker actually attains its specified ideal target response in all measurement positions depends mainly on the following two factors:

1. If the impulse response of the loudspeaker and the room is not entirely of minimum phase character, then the compensating filter must be of so-called mixed phase type, in order to correct for the distortion components that are not minimum phase. As nearly all loudspeaker-room impulse responses contain non-minimum phase components [23], a minimum phase filter will be insufficient for compensating the system so that it fully reaches the target response. As the design of mixed-phase filters for audio use is considerably less straightforward than the design of minimum phase filters, most existing products for digital precompensation make use of filters that are restricted to be of minimum phase type.
2. If the impulse response of a loudspeaker varies between different measurement positions, as is normally the case in a room, then a single filter will not be able to fully correct the response of the loudspeaker at all measurement positions due to conflicting requirements at different positions. In an average sense the response of the compensated system may be closer to the target, but due to the spatial variability of the system, there will always be remaining errors at each measurement position. Moreover, if a mixed-phase compensator is used, then errors may occur in the form of so-called "pre-ringings" unless the compensator is designed with great caution [5]. Pre-ringing errors are known to be perceptually much more objectionable than post-ringings. In [5, 6] it is shown how to design a mixed-phase compensator that alleviates the problem of pre-ringing errors, by correcting only for the non-minimum phase distortion that is common to all measurement positions.

Thus, the method of single-channel compensation has a potential limitation in that it can only correct the impulse and frequency responses in an average sense when multiple measurement positions are considered. In an acoustic environment where the original response of a loudspeaker varies a lot between measurement positions, this variability will remain also in the responses of the compensated loudspeaker, although the compensated system's performance on average is closer to the target performance. Moreover, designing a compensator with respect to only one measurement position is not a realistic option because it is well known that single-point designs yield filters that are extremely non-robust and degrade the system's performance at all other positions in the room [13, 14].

It can thus be concluded that single-channel precompensation methods are most effective for correcting degradations that are systematic over the spatial region of interest, i.e., distortion components that are common, or at least nearly common, to all measurement positions. Typically, such systematic degradations are caused by the loudspeaker itself, or by reflecting surfaces very close to the loudspeaker, or by the room acoustics at low frequencies, where the wavelength is large compared to the region of interest. If a sound reproduction system, including its acoustic environment, is such that its spatially varying distortion dominates over its spatially common distortion, then the sound quality improvement offered by single-channel methods is unfortunately rather small.

Considering the above, one may ask whether a precompensation strategy of higher performance can be obtained, for example by using loudspeakers and filter structures in a more flexible way than what is suggested by the established single-channel methods. In the acoustics-related research literature, a few different strategies that go beyond traditional single-channel filtering have been identified [2, 7, 9, 10, 11, 12, 18, 21, 22, 24, 25, 29, 33, 34]. In summary, the known methods can be grouped into the following categories.

1. The methods in the first category are based on physical insight about room acoustics and particularly the acoustic coupling between loudspeakers and the low-frequency resonance modes of the room. It is well known that a carefully selected physical placement of loudspeakers and the use of several subwoofers are helpful to reduce the effect of room modes [34].
2. Another principle is the source-sink method [7, 8, 33] where the room modes are reduced by positioning a number of subwoofers symmetrically in the room, whereafter delay-, gain- and phase adjustments are applied to the different subwoofer channels. According to this method, the subwoofers at the front wall of the room act as sources of sound, whereas the delay-, gain- and phase adjusted subwoofers at the rear wall act as sinks, i.e., absorbers of sound, which cancel the low-frequency reflections from the rear wall. The method is, however, restricted to work only on the lowest part of the spectrum (below 150 Hz), and the type of adjustments made to the subwoofer signals are very primitive.
3. A third important method is modal equalization [16, 21], in which the modal resonances and their decay times are equalized by digital prefilters. This method involves an explicit identification of the center frequencies and decay times of single room modes, and it is limited to work at very low frequencies (typically only below 200 Hz) where the room resonances are assumed to be distinct and well separated on the frequency axis. Reference [16] discusses two possible approaches, Type I which is a single-channel equalizer and Type II which uses two or more channels for canceling the room modes. It is acknowledged in [16] that the filter design for Type II modal equalization is not straightforward when more than two channels are used, and an explicit solution to the multichannel design case is not presented. Altogether, the approach is unsatisfactory since it relies on assumptions that are in general not fulfilled in a typical room, for example that all modes subject to equalization are well separated and estimable with high precision.
4. A fourth category of methods is based on multichannel filter design under various objectives. One objective is active noise control, where the sound from one or several loudspeakers are used to cancel unwanted acoustic disturbances, see e.g., [11]. A second objective is to obtain an exact reproduction of specific sound pressures in a small number of spatial positions, typically the positions of the ears of a human listener. This approach is often referred to as crosstalk cancellation, virtual acoustic imaging, or transaural stereo [2, 22, 24, 25]. A drawback of this approach is that its performance is extremely sensitive to small movements of the listener, and it is particularly nonrobust in normal reverberant rooms. A third common objective relates to "holophonic" audio rendering techniques such as Wave Field Synthesis (WFS) and High Order Ambisonics (HOA) [10, 28, 30], which aim at reproducing arbitrary sound fields over large regions in two or three dimensions, using massive loudspeaker arrays of 50 or more loudspeakers. A number of multichannel filter designs have been proposed in order to improve the performance of WFS, HOA and related techniques, see e.g., [9, 12, 18, 29]. A fourth objective concerns the minimization of destructive phase interaction in the crossover frequency region, between subwoofer and satellite loudspeakers in sound systems employing so-called bass management [3]. These mentioned multichannel filter designs are not suitable as solutions to the general loudspeaker precompensation problem. First, they are significantly different in their objectives compared to the single-channel precompensation methods. Second, the proposed computational methods yield filters with unsatisfactory properties. For example, most methods design filters in the frequency domain without regard to broadband filter behavior such as causality, the maximum allowed delay through the system and the level and duration of pre-ringing errors.

None of the multichannel filter design methods in the prior art are useful for the purpose of robust wide-band loudspeaker/room compensation of an existing loudspeaker set-up for stereo or multichannel audio reproduction.

SUMMARY OF THE INVENTION

It is a general objective to provide an extended precompensation strategy for improving the reproduction of stereo or multi-channel audio material over two or more loudspeakers.

It is a specific objective to provide a method for determining an audio precompensation controller for an associated sound generating system.

It is another specific objective to provide a system for determining an audio precompensation controller for an associated sound generating system.

It is yet another specific objective to provide a computer program product for determining an audio precompensation controller for an associated sound generating system.

It is also a specific object to provide an improved audio precompensation controller, as well as an audio system comprising such an audio precompensation controller and a digital audio signal generated by such an audio precompensation controller.

These and other objects are met by the invention as defined by the accompanying patent claims.

A basic idea is to determine an audio precompensation controller for an associated sound generating system comprising a total of N≥2 loudspeakers, each having a loudspeaker input. The audio precompensation controller has a number L≥1 inputs for L input signal(s) and N outputs for N controller output signals, one to each loudspeaker of the sound generating system, and the audio precompensation controller generally has a number of adjustable filter parameters. It is relevant to estimate, for each one of at least a subset of the N loudspeaker inputs, an impulse response at each of a plurality M≥2 of measurement positions, distributed in a region of interest in a listening environment, based on sound measurements at the M measurement positions. It is also important to specify, for each one of the L input signal(s), a selected one of the N loudspeakers as a primary loudspeaker and a selected subset S including at least one of the N loudspeakers as support loudspeaker(s), where the primary loudspeaker is not part of this subset. A key point is to specify, for each primary loudspeaker, a target impulse response at each of the M measurement positions with the target impulse response having an acoustic propagation delay, where the acoustic propagation delay is determined based on the distance from the primary loudspeaker to the respective measurement position. The idea is then to determine, for each one of the L input signal(s), based on the selected primary loudspeaker and the selected support loudspeaker(s), filter parameters of the audio precompensation controller so that a criterion function is optimized under the constraint of stability of the dynamics of the audio precompensation controller. The criterion function includes a weighted summation of powers of differences between the compensated estimated impulse responses and the target impulse responses over the M measurement positions.

The different aspects of the invention include a method, system and computer program for determining an audio precompensation controller, a so determined precompensation controller, an audio system incorporating such an audio precompensation controller as well as a digital audio signal generated by such an audio precompensation controller.

The present invention offers the following advantages:

- Improved design scheme for an audio precompensation controller.
- Improved reproduction of stereo or multi-channel audio material over two or more loudspeakers.
- Better performance in rooms or listening environments where the impulse responses of the loudspeakers are varying with spatial position.
- Higher flexibility where the performance improvements are not constrained to low frequencies.
- Control over issues such as causality and pre-ringing artifacts.

Other advantages and features offered by the present invention will be appreciated upon reading of the following description of the embodiments of the invention.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the drawings, the same reference numbers are used for similar or corresponding elements.

The proposed technology is based on the recognition that mathematical models of dynamic systems, and model-based optimization of digital precompensation filters, provide powerful tools for designing filters that improve the performance of various types of audio equipment by modifying the input signals to the equipment. It is furthermore noted that appropriate models can be obtained by measurements at a plurality of measurement positions distributed in a region of interest in a listening environment.

Figure 3:
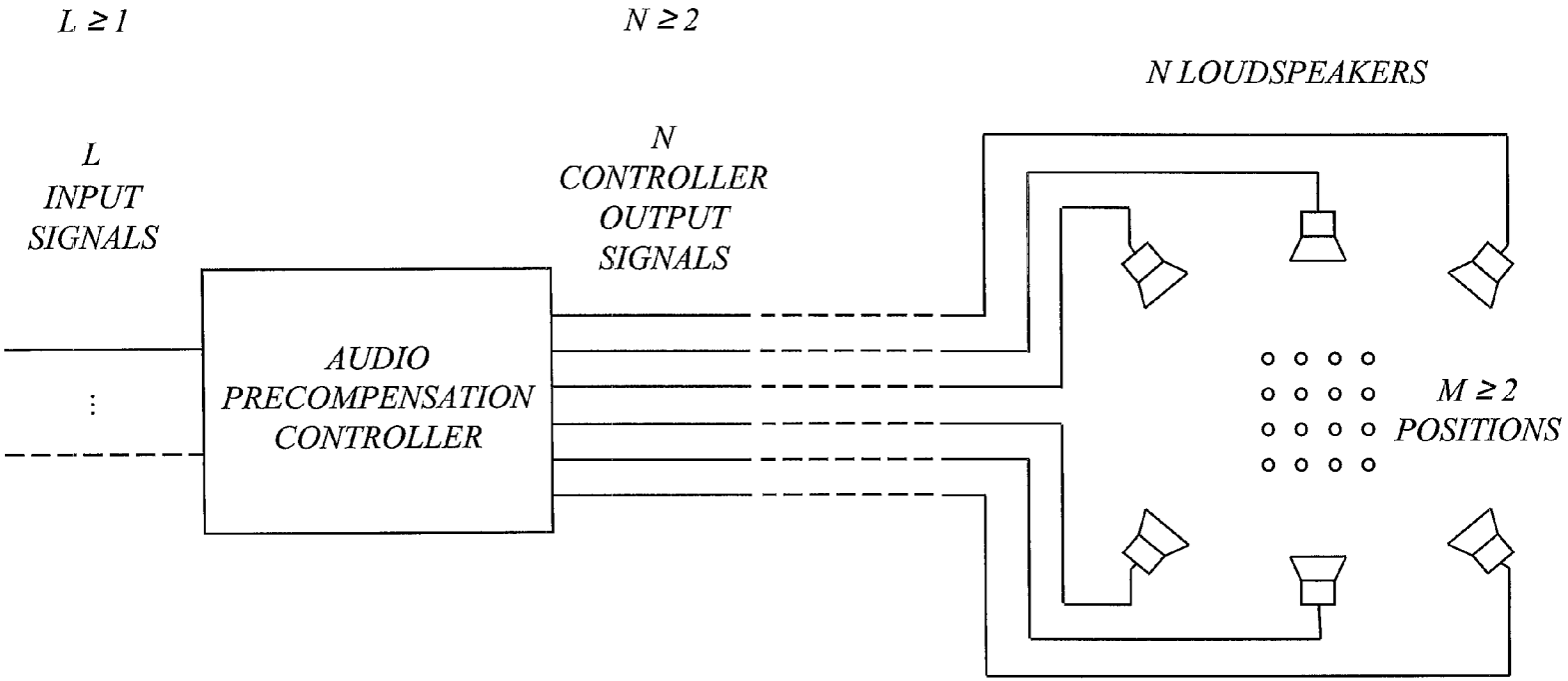
FIG. 3 is a schematic diagram illustrating an example of an audio system including a sound generating system and an audio precompensation controller.

As mentioned, a basic idea is to determine an audio precompensation controller for an associated sound generating system. As illustrated in the example of FIG. 3, the sound generating system comprises a total of $N \geq 2$ loudspeakers, each having a loudspeaker input. The audio precompensation controller has a number $L \geq 1$ inputs for L input signal(s) and N outputs for N controller output signals, one to each loudspeaker of the sound generating system. It should be understood that the controller output signals are directed to the loudspeakers, i.e. in the input path of the loudspeakers. The controller output signals may be transferred to the loudspeaker inputs via optional circuitry (indicated by the dashed lines) such as digital-to-analog converters, amplifiers and additional filters. The optional circuitry may also include a wireless link.

In general, the audio precompensation controller has a number of adjustable filter parameters, to be determined in the filter design scheme. The audio precompensation controller, when designed, should thus generate N controller output signals to the sound generating system with the aim of modifying the dynamic response of the compensated system, as measured in a plurality $M \geq 2$ of measurement positions, distributed in a region of interest in a listening environment.

Figure 5:
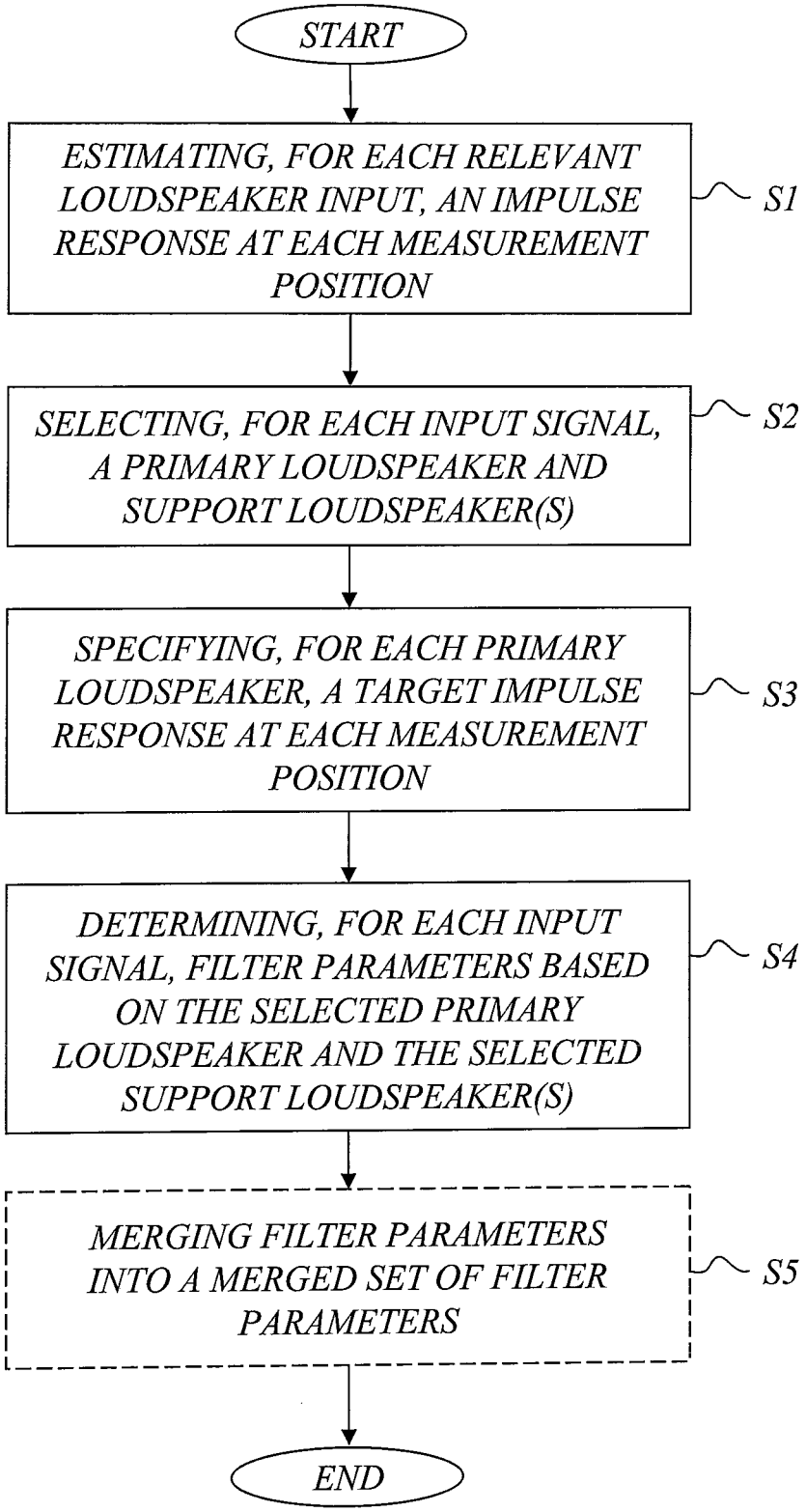
FIG. 5 is a schematic flow diagram illustrating a method for determining an audio precompensation controller according to an exemplary embodiment.

FIG. 5 is a schematic flow diagram illustrating a method for determining an audio precompensation controller according to an exemplary embodiment. Step S1 involves estimating, for each one of at least a subset of the N loudspeaker inputs, an impulse response at each of a plurality $M \geq 2$ of measurement positions, distributed in a region of interest in a listening environment, based on sound measurements at the M measurement positions. Step S2 involves specifying, for each one of the L input signal(s), a selected one of the N loudspeakers as a primary loudspeaker and a selected subset S including at least one of the N loudspeakers as support loudspeaker(s), where the primary loudspeaker is not part of the subset. Step S3 involves specifying, for each primary loudspeaker, a target impulse response at each of the M measurement positions with the target impulse response having an acoustic propagation delay, where the acoustic propagation delay is determined based on the distance from the primary loudspeaker to the respective measurement position. Step S4 involves determining, for each one of the L input signal(s), based on the selected primary loudspeaker and the selected support loudspeaker(s), filter parameters of the audio precompensation controller so that a criterion function is optimized under the constraint of stability of the dynamics of the audio precompensation controller. The criterion function includes a weighted summation of powers of differences between the compensated estimated impulse responses and the target impulse responses over the M measurement positions.

Expressed differently, the audio precompensation controller is configured for controlling the acoustic response of P primary loudspeakers, where $P \leq L$ and $P \leq N$, by the combined use of the P primary loudspeakers and, for each primary loudspeaker, an additional number of support loudspeakers $1 \leq S \leq N-1$ of the N loudspeakers.

If there are two or more input signals, i.e. $L \geq 2$, the method may also include the optional step S5 of merging all of the filter parameters, determined for the L input signals, into a merged set of filter parameters for the audio precompensation controller. The audio precompensation controller, with the merged set of filter parameters, is configured for operating on the L input signals to generate the N controller output signals to the loudspeakers to attain the target impulse responses.

By way of example, it may be desirable for the audio precompensation controller to have the ability of producing output zero to some of the N loudspeakers for some setting of its adjustable filter parameters.

Preferably, the target impulse responses are non-zero and include adjustable parameters that can be modified within prescribed limits. For example, the adjustable parameters of the target impulse responses, as well as the adjustable parameters of the audio precompensation controller, may be adjusted jointly, with the aim of optimizing the criterion function.

In a particular example embodiment, the step of determining filter parameters of the audio precompensation controller is based on a Linear Quadratic Gaussian (LQG) optimization of the parameters of a stable, linear and causal multivariable feedforward controller based on a given target dynamical system, and a dynamical model of the sound generating system. As mentioned, the controller output signals may be transferred to the loudspeaker inputs via optional circuitry. For example, each one of the N controller output signals of the audio precompensation controller may be fed to a respective loudspeaker via an all-pass filter including a phase compensation component and a delay component, yielding N filtered controller output signals.

Optionally, the criterion function includes penalty terms, with the penalty terms being such that the audio precompensation controller, obtained by optimizing the criterion function, produces signal levels of constrained magnitude on a selected subset of the precompensation controller outputs, yielding constrained signal levels on selected loudspeaker inputs to the N loudspeakers for specified frequency bands.

The penalty terms may be differently chosen a number of times, and the step of determining filter parameters of the audio precompensation controller is repeated for each choice of the penalty terms, resulting in a number of instances of the audio precompensation controller, each of which produces signal levels with individually constrained magnitudes to the S support loudspeakers for specified frequency bands.

In a further optional embodiment, the criterion function contains a representation of possible errors in the estimated impulse responses. This error representation is designed as a set of models that describe the assumed range of errors. In this particular embodiment, the criterion function also contains an aggregation operation which can be a sum, a weighted sum, or a statistical expectation over said set of models.

In a particular example, the step of determining filter parameters of the audio precompensation controller is also based on adjusting filter parameters of the audio precompensation controller to reach a target magnitude frequency response of the sound generating system including the audio precompensation controller, in at least a subset of the M measurement positions.

By way of example, the step of adjusting filter parameters of the audio precompensation controller is based on the evaluation of magnitude frequency responses in at least a subset of the M measurement positions and thereafter determining a minimum phase model of the sound generating system including the audio precompensation controller.

Preferably, the step of estimating, for each one of at least a subset of the N loudspeaker inputs, an impulse response at each of a plurality M of measurement positions is based on a model describing the dynamical response of the sound generating system at the M measurement positions.

As understood by a skilled person, the audio precompensation controller may be created by implementing the filter parameters in an audio filter structure. The audio filter structure is then typically embodied together with the sound generating system to enable generation of the target impulse response at the M measurement positions in the listening environment.

The proposed technology may be used in many audio applications. For example, the sound generating system may be a car audio system or mobile studio audio system and the listening environment may be part of a car or a mobile studio. Other examples of sound generating system include a cinema theatre audio system, concert hall audio system, home audio system, or a professional audio system, where the corresponding listening environment is part of a cinema theatre, a concert hall, a home, a studio, an auditorium, or any other premises.

The proposed technology will now be described in more detail with reference to various nonlimiting, exemplary embodiments.

Sound Field Control by Linear Dynamic Precompensation

Linear filters, dynamic systems or models that may have multiple inputs and/or multiple outputs are represented by transfer function matrices in the following and are denoted by boldface calligraphic letters, as for example $\mathcal{H}(q^{-1})$ or simply $\mathcal{H}$. A special case of a transfer function matrix is a matrix that includes only FIR filters as elements. Such matrices will be referred to as polynomial matrices and are denoted by bold italic capitals as for example $B(q^{-1})$ or simply B. Here $q^{-1}$ is the backward shift operator which, when operating on a signal s(t), results in $s(t-1)$ i.e., $q^{-1}s(t)=s(t-1)$. Similarly, $qs(t)=s(t+1)$. When evaluating a polynomial or rational matrix in the frequency domain, the complex variable z or $e^{jw}$ is exchanged for q. A causal matrix of FIR filters (polynomial matrix) $B(q^{-1})$ operates only on input signals that are current or past with respect to the present time index t. It will thus have matrix elements that are polynomials in the backward shift operator $q^{-1}$ only. Similarly, a polynomial matrix $B(q, q^{-1})$ will operate on both future and past signals, whereas B(q) will operate on future signals only. A superscript $(\bullet)^T$ as for example $B^T(q^{-1})$, or $B^T$, means transpose, and when used for a vector, a rational- or a polynomial matrix it means that a row vector transposed becomes a column vector, and the j:th row of a rational- or a polynomial matrix is becoming the j:th column of the same matrix. Similarly, a subscript $(\bullet)_*$ means complex conjugate transpose. It means that the vector, the rational-, or polynomial matrix will be transposed, as explained above, and their elements will be complex conjugated. For example, a rational matrix $F(q^{-1})$ complex conjugated transposed is denoted $F_*(q)$. An identity matrix is a constant matrix with ones on the diagonal. It is denoted I, or $I_N$, if the dimension is N×N. Another constant matrix, e.g., $0_N$ denotes a zero matrix of dimension N×N. Furthermore, $\mathrm{diag}([F_1 \ldots F_N]^T)$ denotes a diagonal matrix with $F_1 \ldots F_N$ on the diagonal, whereas trP denotes the trace of the matrix P, which is the sum of the diagonal elements of P.

Figure 1:
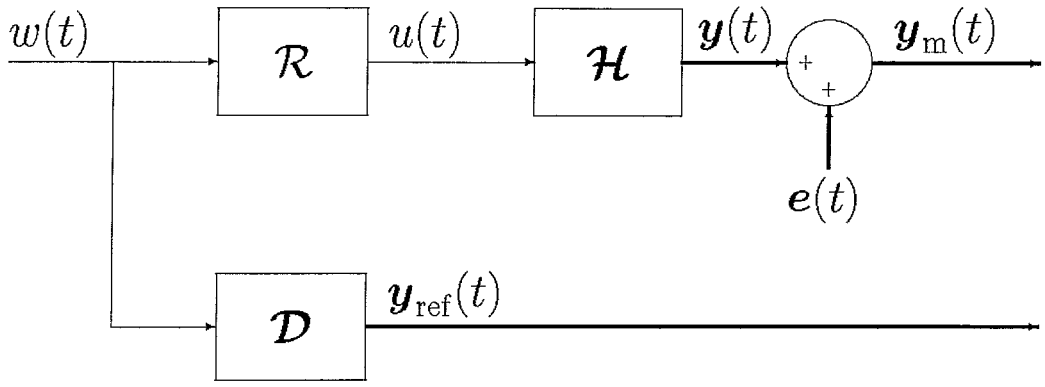
FIG. 1 describes a single-channel compensator $\mathcal{R}$, that has a signal w(t) as input signal. The compensator produces a control signal u(t) that acts as input to the stable linear dynamic single-input multiple-output (SIMO) model $\mathcal{H}$ of the acoustic system. The model $\mathcal{H}$ has one input and M outputs, where the M outputs represent M measurement positions. The acoustic signals at the M measurement positions are represented by a column vector y(t). The desired dynamic system properties are specified by a stable SIMO model $\mathcal{D}$, which has one input and M outputs. When the signal w(t) is used as input to $\mathcal{D}$, the resulting output is a desired signal vector $y_{ref}(t)$ with M elements. The M-dimensional signal vector $y_m(t)$ represents a measurement of y(t) and the signal vector e(t), which also has dimension M, represents a possible measurement disturbance.
Figure 2:
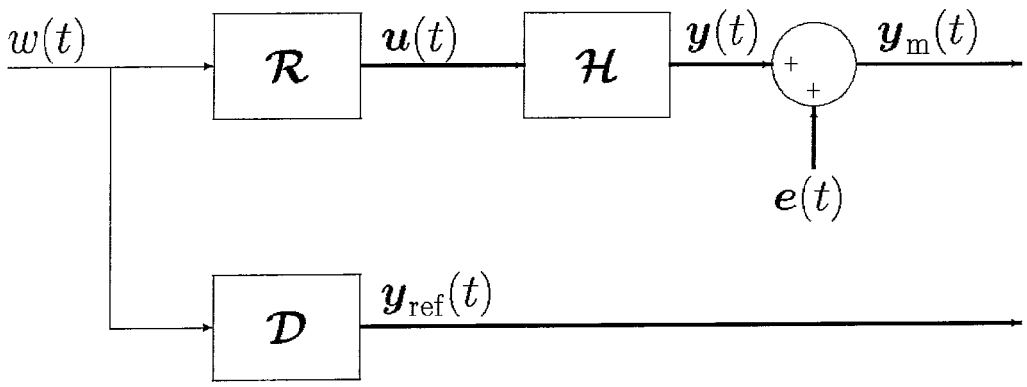
FIG. 2 describes a multichannel compensator $\mathcal{R}$, that has a signal w(t) as input signal. The compensator produces a multichannel control signal u(t) with N elements that acts as input to the stable linear dynamic multiple-input multiple-output (MIMO) model $\mathcal{H}$ of the acoustic system. The model $\mathcal{H}$ z,37 has N inputs and M outputs, where the N inputs represent the inputs to N loudspeakers and the M outputs represent M measurement positions. The acoustic signals at the M measurement positions are represented by a column vector y(t). The desired dynamic system properties are specified by a stable SIMO model $\mathcal{D}$, which has one input and M outputs. When the signal w(t) is used as input to $\mathcal{D}$, the resulting output is a desired signal vector $y_{ref}(t)$ with M elements. The M-dimensional signal vector $y_m(t)$ represents a measurement of y(t) and the signal vector e(t), which also has dimension M, represents a possible measurement disturbance.

The sound generating or reproducing system to be modified will be represented as in FIG. 2 by a linear time-invariant and stable dynamic model $\mathcal{H}$ that describes the relation in discrete time between a set of N input signals u(t) to a set of M modeled output signals y(t):

$$y(t) = \begin{bmatrix} y_1(t) \\ \vdots \\ y_M(t) \end{bmatrix} = \begin{bmatrix} \mathcal{H}_{11} & \ldots & \mathcal{H}_{1N} \\ \vdots & & \vdots \\ \mathcal{H}_{M1} & \ldots & \mathcal{H}_{MN} \end{bmatrix} \begin{bmatrix} u_1(t) \\ \vdots \\ u_N(t) \end{bmatrix} = \mathcal{H}u(t) \tag{1}$$

$$y_m(t) = \begin{bmatrix} y_{m1}(t) \\ \vdots \\ y_{mM}(t) \end{bmatrix} = \begin{bmatrix} y_1(t) \\ \vdots \\ y_M(t) \end{bmatrix} + \begin{bmatrix} e_1(t) \\ \vdots \\ e_M(t) \end{bmatrix} = y(t) + e(t)$$

where t is an integer that represents a discrete time index (a unit sampling time is assumed, where, e.g., t+1 means one sample time ahead of time t) and the signal y(t) is a M-dimensional column vector representing the modeled sound pressure time-series at the M measurement positions. The operator $\mathcal{H}$ represents a model of the acoustic dynamic response, in the form of a transfer function matrix. It is a matrix of dimension M×N whose elements are stable linear dynamic operators or transforms, e.g., represented as FIR filters or IIR filters. These filters determine the response y(t) to a N-dimensional time-dependent input vector u(t). If the M×N model $\mathcal{H}$ contains IIR filters as elements, then it can be written on so-called right Matrix Fraction Description (right MFD) form, $$\mathcal{H}(q^{-1})=B(q^{-1})A^{-1}(q^{-1}) \tag{2}$$

where $B(q^{-1})$ and $A(q^{-1})$ are polynomial matrices of dimensions M×N and N×N, respectively [15]. The right MFD form, which will be highly utilized in the following description, includes the FIR filter matrix as a special case by setting the denominator matrix to the identity matrix, i.e., A=I.

The transfer function matrix $\mathcal{H}$ represents the effect of the whole or a part of the sound generating, or sound reproducing system, including any pre-existing digital compensators, digital-toanalog converters, analog amplifiers, loudspeakers, cables and the room acoustic response. In other words, the transfer function matrix $\mathcal{H}$ represents the dynamic response of relevant parts of a sound generating system. The input signal u(t) to the system, which is a N-dimensional column vector, may represent input signals to N individual amplifier-loudspeaker chains of the sound generating system. The signal $y_m(t)$ (with subscript m denoting "measurement") is a M-dimensional column vector representing the true (measured) sound time-series at the M measurement positions and e(t) represents background noise, unmodelled room reflections, effects of an incorrect model structure, nonlinear distortion and other unmodelled contributions. Each M-dimensional column of $\mathcal{H}$ then represents the M transfer functions between one of the N loudspeaker inputs and the M measurement positions.

The model $\mathcal{H}$ may also include additive or multiplicative model uncertainties, here represented by a rational matrix Δ

$\mathcal{H}$. If, for example, the model uncertainties $\Delta\mathcal{H}$ are parameterized by polynomial matrices with random coefficients, then a suitable model would be $$\mathcal{H}(q^{-1})=\mathcal{H}_0(q^{-1})+\Delta\mathcal{H}(q^{-1}) \tag{3}$$

where $\mathcal{H}_0(q^{-1})$ is the nominal model and $\Delta\mathcal{H}(q^{-1})$, which is partly parameterized by random variables, constitutes the uncertainty model. Writing out the matrix fractions for $\mathcal{H}(q^{-1})$ and $\Delta\mathcal{H}(q^{-1})$, the decomposition (3) of $\mathcal{H}(q^{-1})$ expands into $$\begin{aligned}\mathcal{H} &= B_0A_0^{-1}+\Delta BB_1A_1^{-1} \\ &= (B_0A_1+\Delta BB_1A_0)(A_0A_1)^{-1} \\ &= (\hat{B}_0+\Delta B\hat{B}_1)(A_0A_1)^{-1} \triangleq BA^{-1}\end{aligned} \tag{4}$$

where $\hat{B}=B_0A_1$, $\hat{B}_1=B_1A_0$, $B=\hat{B}_0+\Delta B\hat{B}$, and $A=A_0A_1$. The matrices $B_0$, $\Delta B$ and B are of dimension M×N, whereas $B_1$, $A_0$, $A_1$ and A are of dimension N×N. The matrices $B_0$ and $A_0$ refer to the nominal model $\mathcal{H}_0$, and the elements of $\Delta B$ are polynomials with stochastic variables as coefficients. For simplicity we will assume these coefficients to have zero mean and unit variance. The filter $B_1A_1^{-1}$ is used for shaping the spectral distribution of the stochastic uncertainty model. It can also be used to accommodate variances of the random coefficients different from unity. In the sequel the denominators $A_0$, $A_1$ and A will, for simplicity, be assumed to be diagonal. If the system is represented as in (3), then $\mathcal{H}(q^{-1})$ can be viewed as a set of models, describing a range of possible errors in the measured response of the system. For a general introduction to the above probabilistic modeling framework, the reader is referred to [27] and references therein. Modeling of uncertainties $\Delta\mathcal{H}$ can be performed in many ways, and the above formulation is merely one example of how it can be accomplished and used in a systematic way.

A general objective of sound field control is to modify the dynamics of the sound generating system represented by (1) in relation to a reference dynamics. For this purpose, a reference matrix (or in this case, a column vector) $\mathcal{D}$ of dynamic systems is introduced:

$$y_{ref}(t)=\begin{bmatrix} y_{ref1}(t) \\ \vdots \\ y_{refM}(t)\end{bmatrix}=\begin{bmatrix}\mathcal{D}_1 \\ \vdots \\ \mathcal{D}_M\end{bmatrix}w(t)=\mathcal{D}w(t) \tag{5}$$

where w(t) is a signal representing a live or recorded sound source, or even an artificially generated digital audio signal, including test signals used for designing the filter. The signal w(t) may, for example, represent a digitally recorded sound, or an analog source that has been sampled and digitized. In (5), the matrix $\mathcal{D}$ is a stable transfer function column vector of dimension M×1 that is assumed to be known. This linear discrete-time dynamic system is to be specified by the designer. It represents the reference dynamics (desired target dynamics) of the vector y(t) in (1). In the compensated system, the signal w(t) will represent one out of totally L input source signals. Its desired effect at the M measurement positions is represented by the elements $\mathcal{D}_1, \ldots, \mathcal{D}_M$ of $\mathcal{D}$ in (5). The system $\mathcal{D}$ may include a set of adjustable parameters. Alternatively, it may indirectly be affected by such a set via its specification.

The audio precompensation controller is assumed to be realized as a multivariable dynamic discrete-time precompensation filter, generally denoted by $\mathcal{R}$ z,35 , which generates an input signal vector u(t) to the audio reproduction system (1) based on linear dynamic processing of the signal w(t):

$$u(t)=\begin{bmatrix}u_1(t) \\ \vdots \\ u_N(t)\end{bmatrix}=\begin{bmatrix}\mathcal{R}_1 \\ \vdots \\ \mathcal{R}_N\end{bmatrix}w(t)=\mathcal{R}w(t) \tag{6}$$

This audio precompensation controller includes a set of adjustable parameters. These parameters should allow sufficient flexibility to modify the input-output dynamic properties of the controller, for example, allowing some elements of $\mathcal{R}$, or the whole of $\mathcal{R}$ to be zero for appropriate parameter settings. The optimization of $\mathcal{R}$ should however be constrained to parameter settings that make $\mathcal{R}$ an input-output stable dynamic system.

Our design objective will be to construct a stable transfer function matrix $\mathcal{R}$ of dimension N×1 that is designed to generate an input signal vector u(t) to the audio reproduction system (1) such that its compensated model output y(t) approximates the reference vector $y_{ref}(t)$ well, according to a specified criterion. This objective would be attained if $$y(t)=\mathcal{H}u(t)=\mathcal{H}\mathcal{R}w(t)\cong y_{ref}(t)=\mathcal{D}w(t) \tag{7}$$

The corresponding model-based approximation error at the M measurement positions is represented by $$\epsilon(t)=y_{ref}(t)-y(t)=(\mathcal{D}-\mathcal{H}\mathcal{R})w(t). \tag{8}$$

The true, measured, error vector will then, by FIG. 2 and (1), be $y_{ref}(t)-y_m(t)=\epsilon(t)-e(t)$. The approximation (7) can never be made exact in practice with a limited number N of loudspeakers, a large number M of measurement positions and complicated wide-band acoustic dynamic models in $\mathcal{H}$. The attainable approximation quality depends on the nature of the problem set-up. For a fixed given acoustic environment, the quality of the approximation can in general be improved if the number of loudspeaker channels N is increased. It may also be improved by increasing the number M of measurement points within the intended listening region, since this gives a denser and more accurate sampling of the sound field as a function of space. Enlargement of the listening region or addition of regions for a fixed N would, in general, result in larger approximation errors.

A scheme for calculating an appropriate approximation for the present problem will be outlined below.

An important aspect to consider when designing a precompensator is the relation between the initial propagation delay of the system to be compensated and the initial propagation delay of the desired target dynamics. The initial propagation delay of a dynamical system is the time it takes for a signal to propagate from the input to the output of the system. In other words, the initial propagation delay is given by the time instant of the first nonzero coefficient of the impulse response of the system. A system $\mathcal{H}$ having an initial propagation delay of d samples can therefore be written as $\mathcal{H}=q^{-d}\tilde{\mathcal{H}}$, where at least one of the elements of $\tilde{\mathcal{H}}$ has an impulse response that starts with a nonzero coefficient.

Consider for example the system in FIG. 2, and suppose that $\mathcal{H}$ has an initial propagation delay $d_1$ and $\mathcal{D}$ has an initial propagation delay $d_0$. If $d_1>d_0$, then a causal compensator $\mathcal{R}$, which uses only present and past values of w(t), cannot be expected to perform well because at time t the reference signal $y_{ref}(t)$ will depend on signal values $w(t-d_0-k)$ for $k\geq 0$, whereas the output y(t) of the compensated system will depend only on $w(t-d_1-k)$, for $k\geq 0$, i.e., the reference signal depends on more recent data than what can be produced at the system output. The compensator aims at steering y(t) towards the reference $y_{ref}(t)$, but due to the time-lag difference between $\mathcal{H}$ and $\mathcal{D}$ the action of the control signal u(t) at the output of $\mathcal{H}$ will always arrive at least $d_1-d_0$ samples later than necessary. In order for the compensator $\mathcal{R}$ to perform well in such a case, it would have to be non-causal, i.e., it would have to be able to predict at least $d_1-d_0$ future values of the signal w(t). If the relation between the initial delays is the opposite, i.e., if $d_1<d_0$, then the compensator will perform considerably better because by the knowledge of d and w(t), the compensator has the possibility to predict future values of the reference signal. The compensator may therefore start acting on the dynamics of $\mathcal{H}$ by $d_0-d_1$ samples in advance, in such a way that the output y(t) is more effectively steered towards the reference $y_{ref}(t)$.

It is thus in general possible to improve the performance of a precompensator by ensuring that the initial delay of the target dynamics $\mathcal{D}$ is large enough compared to the initial delay of the system $\mathcal{H}$. For example, this can be obtained by adding an overall bulk delay $q^{-d_0}$ to the target, so that $\mathcal{D}=q^{-d_0}\tilde{\mathcal{D}}$, where $\tilde{\mathcal{D}}$ is the original intended target dynamics, and $d_0$ is larger than or equal to the initial propagation delay of W.

For audio reproduction purposes, however, allowing a large bulk delay $q^{-d_0}$ in the target can be problematic. On the one hand, it is generally true that a large bulk delay in the target dynamics is helpful for reducing the average reproduction error, e.g., $E\{\|y_{ref}(t)-y(t)\|_2^2\}$. On the other hand, as described above, a large bulk delay in the target allows the compensator to act on the system in a predictive way, i.e., the output y(t) may depend on data w(t) that is "in the future" compared to the data that constitutes the signal $y_{ref}(t)$. As the reproduction error $y_{ref}(t)-y(t)$ is not necessarily zero, this predictive behavior may cause errors that are perceived as pre-ringings or pre-echoes in the compensated system. Technically it means that the impulse response of the compensated system contains sound energy that arrives before the intended bulk delay $d_0$. Especially for impulsive and transient sounds, such pre-ringing errors are perceived by humans as very unnatural and annoying, and they should therefore be avoided if possible. In the above example, the length of the time interval where pre-ringing errors may occur is determined by the difference between the initial propagation delays of $\mathcal{H}$ and $\mathcal{D}$. It is thus of interest to use a bulk delay that is large enough to allow the compensator to work properly, but not so large that the compensator can produce audible pre-ringing errors. In other words, to minimize the pre-ringing effects one should use $d_1\leq d_0$ in the above example, with $d_1$ as close to $d_0$ as possible.

However, it is well known that a large target bulk delay (also called modeling delay or smoothing lag) can improve the performance considerably when the system to be compensated contains non-minimum phase distortion. Moreover, for the single-channel case there exists a method for compensation of non-minimum phase distortion and which does not produce pre-ringings [4, 5, 6]. The method in question uses a large target bulk delay $q^{-d_0}$ in combination with a noncausal all-pass filter $F_*(q)$ that compensates the non-minimum phase distortion that is common to all spatial positions. If the delay $d_0$ is large enough, then the resulting noncausal filter $q^{-d_0}F_*(q)$ can be approximated with a causal FIR filter, which is included as a fixed part of the compensator. After $q^{-d_0}F_*(q)$ has been designed, an optimal causal and stable compensator $\mathcal{R}_1$ is designed for the augmented system $\tilde{\mathcal{H}}=q^{-d_0}F_*(q)\mathcal{H}$, whose initial propagation delay is $d_0$. When the causal filter $\mathcal{R}_1$ is designed, a bulk delay of $d_0$ is still used in the target, which means that the initial propagation delays of the augmented system $\tilde{\mathcal{H}}$ and the target $\mathcal{D}$ are identical. The causal filter $\mathcal{R}_1$ can therefore not add any pre-ringings to the system.

The above method for single-channel compensation without pre-ringings can be exploited also in the design of multichannel compensators, as a "pre-conditioning" step, in which the individual channels of the system are corrected with respect to phase distortion before the multichannel compensator is designed. By extending this approach, a single-channel phase compensator $q^{-(d_0-d_j)}F_*(q)$, $j=1,\ldots,N$, is designed for each of the N loudspeakers of the system, and a diagonal N-channel block of filters is then placed between the N-channel system $\mathcal{H}$ and the optimal causal N-channel compensator that is to be designed. That is, the system to be compensated becomes $$\tilde{\mathcal{H}}(q^{-1})=\mathcal{H}(q^{-1})\tilde{\Delta}(q^{-1})F_*(q) \tag{9}$$

where $\tilde{\Delta}(q^{-1})$ and $F_*(q)$ are diagonal N×N matrices given by $$\tilde{\Delta}(q^{-1})=\mathrm{diag}([q^{-(d_0-d_1)}\ \ldots\ q^{-(d_0-d_1)}]^T) \tag{10}$$

$$F_*(q)=\mathrm{diag}([F_{1*}(q)\ \ldots\ F_{N*}(q)]^T). \tag{10}$$

The extra delays values $d_1,\ldots,d_N$ above can be used to fine-tune the relation between the initial propagation delay of the target system $\mathcal{D}$ and the initial propagation delays of the N loudspeaker channels (i.e., the initial propagation delays of the columns of $\mathcal{H}$).

Acoustic Modeling

The room-acoustic impulse responses of each of N loudspeakers are estimated from measurements at M positions which are distributed over the spatial region of intended listener positions. It is recommended that the number of measurement positions M is larger than the number of loudspeakers N. The dynamic acoustic responses can then be estimated by sending out test signals from the loudspeakers, one loudspeaker at a time, and recording the resulting acoustic signals at all M measurement positions. Test signals such as white or colored noise or swept sinusoids may be used for this purpose. Models of the linear dynamic responses from one loudspeaker to M outputs can then be estimated in the form of FIR or IIR filters with one input and M outputs. Various system identification techniques such as the least squares method or Fourier-transform based techniques can be used for this purpose. The measurement procedure is repeated for all loudspeakers, finally resulting in a model $\mathcal{H}$ that is represented by a M×N matrix of dynamic models. The multiple input-multiple output (MIMO) model may alternatively be represented by a state-space description.

An example of a mathematically convenient, although very general, MIMO model for representing a sound reproduction system is by means of a right MFD with diagonal denominator, $$\mathcal{H}(q^{-1}) = B(q^{-1})A^{-1}(q^{-1}) = \begin{bmatrix} B_{11}(q^{-1}) & \dots & \dots & B_{1N}(q^{-1}) \\ \vdots & & & \vdots \\ \vdots & & & \vdots \\ B_{M1}(q^{-1}) & \dots & \dots & B_{MN}(q^{-1}) \end{bmatrix} \begin{bmatrix} A_1(q^{-1}) & 0 & \dots & 0 \\ 0 & \ddots & & \vdots \\ \vdots & & \ddots & 0 \\ 0 & \dots & 0 & A_N(q^{-1}) \end{bmatrix}^{-1}, \tag{11}$$

which is the type of MFD that will be utilized in the following. An even more general model can be obtained if the matrix $A(q^{-1})$ is allowed to be a full polynomial matrix, and there is nothing in principle that prohibits the use of such a structure. However, we shall adhere to the structure (11) in the following, as it allows a more transparent mathematical derivation of the optimal controller. Note that $\mathcal{H}$ as defined in (11) may include a parametrization that describes model errors and uncertainties, as given for example by (4).

Selection of Primary and Support Loudspeakers

For a given sound reproduction system, a precompensation controller is to be designed with the aim of improving the acoustic reproduction of L source signals by at least one physical loudspeaker. To improve the acoustic reproduction here means that the impulse response of a physical loudspeaker, as measured in a number of points, is altered by the compensator in such a way that its deviation from a specified ideal target response is minimized.

In order to obtain a compensator that is more general than existing single-channel compensators, the present design is performed under as few restrictions as possible regarding filter structures and how the loudspeakers are used. The only restrictions posed on the compensator is linearity, causality and stability. The restriction of single-channel compensators, i.e., the restriction that each of the L source signals can be processed by only one single filter and distributed to only one loudspeaker input, is here relaxed. The compensator associated with each one of the L source signals is thus allowed to consist of more than one filter, yielding at least one, but possibly several, processed versions of the source signal, to be distributed to at least one, but possibly several, loudspeakers.

We assume here that the L source signals have been produced with some particular intended physical loudspeaker layout in mind. This layout is assumed to consist of at most L loudspeakers, and each of the L source signals is intended to be fed into at most one loudspeaker input. For example, an established audio source format such as two-channel stereo (L=2) is intended to be played back through a pair of loudspeakers positioned symmetrically in front of the listener, where the first source channel is fed to the left loudspeaker and the second source channel is fed to the right loudspeaker. Another source format is 5.1 surround which consists of totally six audio channels (L=6) that are intended to be played back in a one-to-one fashion (i.e., without any cross-mixing of channels) through five loudspeakers and a subwoofer. In the case that the source signals are a result of some upmixing algorithm (for example an algorithm that produces a six-channel 5.1 surround material out of a two-channel stereo recording), we shall associate L with the number of channels in the upmixed material (i.e., in the example of stereo-to-5.1 surround upmix, we shall use L=6 rather than L=2). In the down-mix case, i.e., when two or more of the L source signals are fed into the same loudspeaker input, we have the situation of an intended loudspeaker layout with less than L loudspeakers.

As mentioned above, we here want to construct a compensator that is allowed to use the loudspeakers of a system more freely. The aim of the compensator design is, however, to make the reproduction performance of the original intended loudspeaker layout as good as possible. To accomplish this we shall, for each one of the L source input signals, distinguish between which loudspeaker belongs to that particular source signal in the original intended layout (this loudspeaker is henceforth called the primary loudspeaker of the concerned source signal), and which additional loudspeakers (henceforth called support loudspeakers) are used by the compensator for improving the performance of the primary loudspeaker.

Suppose that we have L source input signals and a system of totally N loudspeakers. Then, for each one of the L source input signals there must be one associated primary loudspeaker. Among the remaining N−1 loudspeakers, we then choose a set of S support loudspeakers, where $1 \le S \le N-1$, to be used by the compensator for improving the performance of the primary loudspeaker.

Recall that if the sound system is represented by a transfer function matrix model, as for example in (1), then each column of $\mathcal{H}$ represents the acoustic response of one loudspeaker at M measurement positions. Thus, one of the columns of $\mathcal{H}$ contains the responses of the primary loudspeaker, and the rest of the columns contain the responses of the S support loudspeakers. Therefore, in a particular design of a compensator for one of the L source inputs, the acoustic model $\mathcal{H}$ contains 1+S columns, and the resulting compensator has one input and 1+S outputs, where 1+S may be less than N, depending on how many support loudspeakers were chosen for that particular source input. Note also that it is not necessary to use the same set of loudspeakers repeatedly when compensators are designed for the remaining L−1 source inputs. The number S of support loudspeakers used by the compensator may therefore not be the same for all of the L source inputs.

Target Sound Field Definition

The aim of loudspeaker precompensation is not to generate an arbitrary sound field in a room, but to improve the acoustic response of an existing physical loudspeaker. The target sound field to be defined for one particular (out of L) input source signals is therefore highly determined by the characteristics of the primary loudspeaker associated with that input source signal. The following example is an illustration of how a target sound field can be specified for a specific primary loudspeaker.

Suppose that the sound system in question is measured in M positions, and is represented with a transfer function matrix $\mathcal{H}$ as in (1). Moreover, suppose that the jth column of $\mathcal{H}$ represents the impulse responses of the considered primary loudspeaker. Then a target sound field can be specified in form of a M×1 column vector of transfer functions, $\mathcal{D}$ as in (5). Typically, the target sound field should be specified as an idealized version of the measured impulse responses of the primary loudspeaker. An example of how such an idealized set of impulse responses can be designed is to use delayed unit pulses as elements in $\mathcal{D}$, i.e., to let the ith element $\mathcal{D}_i$ of $\mathcal{D}$ be defined as $\mathcal{D}_i(q^{-1}) = q^{-d_0\Delta_i}$, where $\Delta_i$ is the initial propagation delay of the ith element of the jth column of $\mathcal{H}$, i.e., $$\mathcal{D}(q^{-1}) = q^{-d_0}\begin{bmatrix} q^{-\Delta_1} \\ \vdots \\ q^{-\Delta_M} \end{bmatrix} \tag{12}$$

The target response in (12) is an idealized version of the primary loudspeaker's impulse response, in the sense that it represents a sound wave whose propagation through space (i.e., over the M measurement positions) is similar to that of the primary loudspeaker, but in the time $d_0$-main the shape of the target sound wave is pulse-like and contains no room echoes. The delays $\Delta_1 \ldots, \Delta_M$ can be determined by detecting the time lag corresponding to of the first coefficient of non-negligible magnitude in each of the impulse responses in the jth column of U. The extra common bulk delay $d_0$ is optional, but should preferably be included if a diagonal phase compensator with lag $d_0$ is used, as suggested in (9), (10).

If there is more than one input source signals, i.e., if L>1, then one target sound field is defined for each of the L signal sources that are to be reproduced by the sound system.

If for some reason the propagation delays $\Delta_1, \ldots, \Delta_M$ cannot be properly detected, are ambiguous or in any way difficult to define, then some controlled variability can be introduced into the target $\mathcal{D}$. For example, the delays $\Delta_1, \ldots, \Delta_M$ can be adjustable within prescribed limits. Such flexibility of the target can help attain better approximation to the selected target, better criterion values and better perceived audio quality. This type of flexibility can be utilized by adjusting the parameters of the target $\mathcal{D}$ and the parameters of the precompensation filter iteratively.

Definition of Optimization Criterion

To obtain analytical techniques for designing audio precompensation filters it is convenient to introduce a scalar criterion that is to be optimized with respect to the adjustable parameters. An example of a suitable criterion consists of a sum or a weighted sum of powers of the difference between the target signal y(t) and the compensated signal y(t) in all M measurement points. This difference will, in the sequel, be called the approximation error, or just the error, and the weighted error respectively, which are represented by $$\epsilon(t)=y_{ref}(t)-y(t)=\mathcal{D}\,w(t)-\mathcal{H}\,u(t)$$

$$z_1(t)=[z_{11}(t)\ \ldots\ z_{1M}(t)]^T=V\epsilon(t). \tag{13}$$

See equations (1), (5) and (8) above. The weighted error $z_1(t)$ is governed by the polynomial matrix V of dimension M×M, which can be a full matrix, a diagonal matrix, or just a constant matrix, depending on in which frequency ranges the error should be emphasized. If V=I i.e., the identity matrix, which is diagonal with ones on the diagonal, then no weighting is applied to the error. Optionally, weighted powers of the N audio precompensator output signals, u(t), see (6), can be added to the criterion. The weighted precompensator output signals will henceforth be called penalty terms, and are represented by $$z_2(t)=[z_{21}(1)\ \ldots\ z_{2M}(t)]^T=Wu(t), \tag{14}$$

where W is a polynomial matrix of dimension N×N. The polynomial matrix W can be a full matrix, it can be diagonal with FIR filters on the diagonal, or it can be just the identity matrix, depending on how and in which frequency ranges the precompensator signals are to be penalized. If no weighting of the penalty is required, then W will just be the identity matrix.

If, for example, $V(q^{-1})$ and $W(q^{-1})$ are diagonal with diagonal elements denoted by $V_i(q^{-1})$ and $W_j(q^{-1})$, (i=1, . . . , M; j=1, . . . , N), respectively, then with the weighting terms $z_1(t)$ and $z_2(t)$ defined as above, an example of an adequate criterion would be $$\begin{aligned} J &= \bar{E}\left\{\sum_{i=1}^{M} E|z_{1i}(t)|^2 + \sum_{j=1}^{N} E|z_{2j}(t)|^2\right\} \\ &= \bar{E}\left\{\sum_{i=1}^{M} E|V_i\varepsilon_i(t)|^2 + \sum_{j=1}^{N} E|W_j u_j(t)|^2\right\} \\ &= \bar{E}\{tr\ E[(Vy)(Vy)^T]\} + tr\ E[(Wu)(Wu)^T] \\ &= \bar{E}\{\|V(\mathcal{D}-\mathcal{H}\mathcal{R})w(t)\|_2^2 + \|W\mathcal{R}w(t)\|_2^2\}. \end{aligned} \tag{15}$$

Here the statistical expectation E is taken with respect to the signal w(t), whereas the statistical expectation E is taken with respect to uncertain model parameters in $\mathcal{H}$, e.g., ΔB in (4), should such a statistical model description have been selected. The last equality of (15) represents the expected value, with respect to the model uncertainty parameters in $\mathcal{H}$, of the squared 2-norm (in (15), the squared 2-norm is denoted as $\|\bullet\|_2^2$) of a random process. The expressions are all equivalent as long as $V(q^{-1})$ and $W(q^{-1})$ are diagonal. The third equality in (15) can be generalized to matrices having FIR filters in all elements.

As an example, consider (15) with $V(q^{-1})$ and $W(q^1)$ being diagonal with FIR filters on the diagonal. If all diagonal elements of $V(q^{-1})$ are low pass filters, then it means that we will prioritize high accuracy (small error) at low frequencies. In a similar manner, if the elements of $W(q^{-1})$ are high pass filters, then the high frequency contents of the audio precompensation filter output will be penalized (i.e., contribute more to the criterion value) than would the low frequency contents. Hence, an audio precompensation filter that strives to minimize the criterion will put its efforts at low frequencies. By selecting different filters for different error and precompensation signals a designer can balance the different loudspeaker outputs against one another. In the special case with all the FIR filters being ones, no weighting is performed. The weighting polynomial matrices $V(q^{-1})$ and $W(q^{-1})$ thus offer considerable flexibility in the design to attain as small an error as possible in the frequency ranges of interest while at the same time use the precompensation signal power wisely.

It is evident that if $V(q^{-1})$ is diagonal, then the first right-hand sum of the criterion (15) represents a weighted summation over the M measurement positions of powers of differences between the compensated estimated impulse responses, represented by elements of $\mathcal{H}\mathcal{R}$, and the target impulse responses, represented by elements of $\mathcal{D}$, where the weighting is performed by the polynomial matrix $V(q^{-1})$ and by the spectral properties of the signal w(t). Equal weighting of all components of the error vector $\epsilon(t)$ would be obtained if a unit matrix $V(q^{-1})=I$ is used and if the signal w(t) is a white noise.

Optimal Controller Design

The criterion (15), which constitutes a squared 2-norm, or other forms of criteria, based e.g., on other norms, can be optimized in several ways with respect to the adjustable parameters of the precompensator $\mathcal{R}$. It is also possible to impose structural constraints on the precompensator, such as e.g., requiring its elements to be FIR filters of certain fixed orders, and then perform optimization of the adjustable parameters under these constraints. Such optimization can be performed with adaptive techniques, or by the use of FIR Wiener filter design methods. However, as all structural constraints lead to a constrained solution space, the attainable performance will be inferior compared with problem formulations without such constraints. Hence, the optimization should preferably be performed without structural constraints on the precompensator, except for causality of the precompensator and stability of the compensated system. With the optimization problem stated as above, the problem becomes a Linear Quadratic Gaussian (LQG) design problem for the multivariable feedforward compensator $\mathcal{R}$.

Linear quadratic theory provides optimal linear controllers, or precompensators, for linear systems and quadratic criteria, see e.g., [1, 19, 20, 31]. If the involved signals are assumed to be Gaussian, then the LQG precompensator, obtained by optimizing the criterion (15) can be shown to be optimal not only among all linear controllers but also among all nonlinear controllers, see e.g., [1]. Hence, optimizing the criterion (15) with respect to the adjustable parameters of $\mathcal{R}$, under the constraint of causality of $\mathcal{R}$ and stability of the compensated system $\mathcal{H}\mathcal{R}$, is very general. With $\mathcal{H}$ and $\mathcal{D}$ assumed stable, stability of the compensated system, or error transfer operator, $\mathcal{D}-\mathcal{H}\mathcal{R}$, is thus equivalent to stability of the controller $\mathcal{R}$.

We will now present the LQG-optimal precompensator for the problem defined by equations (1)-(14) and the criterion (15). The solution is given in transfer operator, or transfer function form, using polynomial matrices. Techniques for deriving such solutions has been presented in e.g., [31]. Alternatively, the solution can be derived by means of state space techniques and the solution of Riccati equations, see e.g., [1, 20].

Polynomial Matrix Design Equations for Optimizing Precompensators

Let the system be described by the model (1) with $\mathcal{H}$ parameterized as in (3), and (4). If no uncertainty modeling is used then we set $\Delta B=0$ and we obtain $W=B_0A_0^{-1}=BA^{-1}$. Moreover, let the target sound field at the M measurement positions be represented by $\mathcal{D}=\mathcal{D}/E$, i.e., $$\mathcal{D}=\begin{bmatrix}\mathcal{D}_1\\ \vdots\\ \mathcal{D}_M\end{bmatrix}=D\frac{1}{E}=\begin{bmatrix}D_1\\ \vdots\\ D_M\end{bmatrix}\frac{1}{E} \tag{16}$$

where $E(q^{-1})$ is either equal to one or is a scalar minimum-phase polynomial.

If maximum attainable compensator performance is desired, under the constraint that preringing artifacts are to be avoided, then an individual phase compensation and time-delay alignment of the involved loudspeakers will preferably be performed prior to the precompensator optimizations. Such phase compensations can be designed according to the principles described in [5], [6]. In order to obtain maximum performance while constraining the solution to not include any preringing artifacts, an all-pass phase compensation filter $q^{-(d_0-d_j)}F_{j*}(q)=q^{-(d_0-d_j)}\overline{F}_{j*}/F_{j*}$, one for each of the N loudspeakers, should be included in each the N signal paths between the system $\mathcal{H}$ and the controller $\mathcal{R}$, and the target should then contain an initial delay of $d_0$ samples, i.e., $$\mathcal{D}=\begin{bmatrix}\tilde{D}_1\\ \vdots\\ \tilde{D}_M\end{bmatrix}\frac{q^{-d_0}}{E} \tag{17}$$

where at least one of the polynomials $\tilde{\mathcal{D}}_1(q^{-1}), \ldots, \tilde{\mathcal{D}}_M(q^{-1})$ has a nonzero leading coefficient. We shall here choose to let the all-pass filters $q^{-(d_0-d_j)}F_{j*}(q)$, $j=1, \ldots, N$ be regarded as a fixed part of the system.

Introduce the delay polynomial matrix $\tilde{\Delta}(q^{-1})$, and the all-pass rational matrix $F(q^{-1})$, respectively, as follows $$\begin{aligned}\tilde{\Delta}(q^{-1})&=\mathrm{diag}\left([\,q^{-(d_0-d_1)}\ \ldots\ q^{-(d_0-d_N)}\,]^T\right)\\ \mathcal{F}(q^{-1})&=\mathrm{diag}\left(\left[\frac{\overline{F}_1(q^{-1})}{F_1(q^{-1})}\ \ldots\ \frac{\overline{F}_N(q^{-1})}{F_N(q^{-1})}\right]^T\right).\end{aligned} \tag{18}$$

Here diag(•) denotes a diagonal matrix with the elements of the vector on the diagonal, $(\bullet)^T$ means the transpose of the same vector, whereas $\overline{F}_j(q^{-1})$ is the reciprocal polynomial of $F_j(q^{-1})$, i.e., the zeros of $\overline{F}_j(z^{-1})$ are in the mirror locations, with respect to the unit circle, to those of $F_j(z^{-1})$. The rational matrix $F(q^{-1})$ is here constructed from excess phase zeros that are common among the transfer functions of each of the N loudspeakers for all M measurement positions. That is, the elements $B_{1j}, \ldots, B_{Mj}$ of the jth column of B in (4) are assumed to share a common excess phase factor $\overline{F}_j(q^{-1})$.

As explained above, $d_0$ in (18) is the intended initial delay of the phase-compensated system, whereas $d_j$, $j=1, \ldots, N$ are individual delays that can be used to accommodate individual deviations in distances among the different loudspeakers. Since $\tilde{\Delta}(q^{-1})$ and $F(q^{-1})$, or equivalently, its complex conjugate transpose, here denoted $F_*(q)$, are fixed and known they can be regarded as factors of an augmented system $\tilde{\mathcal{H}}(q^{-1})$ represented as, $$\begin{aligned}\tilde{\mathcal{H}}(q^{-1})&\triangleq\mathcal{H}(q^{-1})\tilde{\Delta}(q^{-1})\mathcal{F}_*(q)\\ &=B(q^{-1})\tilde{\Delta}(q^{-1})\mathcal{F}_*(q)A^{-1}(q^{-1})\\ &=\left(\hat{B}_0(q^{-1})+\Delta B(q^{-1})\hat{B}_1(q^{-1})\right)\tilde{\Delta}(q^{-1})\mathcal{F}_*(q)A^{-1}(q^{-1})\\ &=\left(\check{B}_0(q^{-1})+\Delta B(q^{-1})\check{B}_1(q^{-1})\right)A^{-1}(q^{-1})\\ &=\tilde{B}(q^{-1})A^{-1}(q^{-1}).\end{aligned} \tag{19}$$

where $\tilde{B}(q^{-1})=B(q^{-1})\tilde{\Delta}(q^{-1})F_*(q)$ is still a polynomial matrix (i.e., not a rational matrix), due to cancellation of factors between B and $F_*$. The second equality of (19) is allowed because A, $\tilde{\Delta}$ and $F_*$ are diagonal, see (4), (11) and (18).

Given the system $\tilde{\mathcal{H}}(q^{-1})$ above, with the fixed and known delay polynomial matrix $\tilde{\Delta}(q^{-1})$, the all-pass rational matrix $F_*(q)$, and assuming the signal w(t) being a zero mean unit variance white noise sequence, then the optimal LQG-precompensator $\mathcal{R}(q^{-1})$, free of preringing artifacts, which minimizes the criterion (15) under the constraint of causality and stability, is obtained as, $$\mathcal{R}=A\beta^{-1}Q\frac{1}{E} \tag{20}$$

where the N|N polynomial matrix $\beta(q^{-1})$ is the unique stable right spectral factor[1] defined by

[1]Such a right spectral factor exists under mild conditions for the current problem. See section 3.3. of [31]. The spectral factor is unique up to an orthogonal matrix.

$$\beta_*\beta=\check{B}_{0*}V_*V\check{B}_0+A_*W_*WA+\check{B}_{1*}\bar{E}\{\Delta\check{B}_*V_*V\Delta B\}\check{B}_1 \tag{21}$$

and the polynomial matrix $Q(q^{-1})$, together with a polynomial matrix $L_*(q)$, both of dimension $N_1$, constitute the unique solution to the bilateral Diophantine equation $$\check{B}_{0*}V_*V\mathcal{D}=\beta_*Q+qL_*E \tag{22}$$

with generic[2] degrees

[2]Lower degrees may occur in special cases.

$$n_Q=\max\{n_D+n_V,n_E-1\}$$

$$n_L=\max\{n_{\check{B}_0}+n_V,n_\beta\}-1. \tag{23}$$

The optimality and uniqueness of the compensator derived above can be proven by using the techniques presented in [27, 31]. The solution presented above, can easily be extended to also account for w(t) being described by a dynamic model i.e., $$w(t)=P(q^{-1})v(t) \tag{24}$$

where v(t) is a zero mean unit variance white noise sequence. If, as an example, $P(q^{-1})=P(q^{-1})S(q^{-1})^{-1}$ with P and S being stable polynomials, then, in the rightmost term of (22) $P^{-1}SE$ is substituted for E. Describing w(t) by a dynamic model can sometimes be useful in certain applications when the assumption of w(t) being a white noise is inappropriate. The solution obtained here is thus very general, which gives considerable flexibility in the design of the precompensator.

The filter design presented above can also be used to design a set of p filters $\{\mathcal{R}_j\}_{j=1}^{p}$ for a selected appropriate set of weighting matrices $\{V_j\}_{j=1}^{p}$, $\{V_j\}_{j=1}^{p}$. The so obtained set of filters $\{\mathcal{R}_j\}_{j=1}^{p}$ can then be used to gradually change the degree of support obtained from the selected set of S support loudspeakers. In that way a user can toggle between very little support to full support to obtain the best possible perceived audio performance.

In order to obtain the precompensator signal $$u(t)=\mathcal{R}w(t)=A\beta^{-1}Q\frac{1}{E}w(t),$$

note that we have to perform the filtering in different steps. Thus, we first perform the recursive filtering $E(q^{-1})w_1(t)=w(t)$, second, the FIR filtering $x_1(t)=Q(q^{-1})w_1(t)$, third, the recursive filtering $\beta(q^{-1})x_2(t)=x_1(t)$, and finally the FIR filtering $u(t)=A(q^{-1})x_2(t)$. Here the bold signals $x_1$, and $x_2$, are of dimension N×1 since u is of dimension N×1. Such a filtering procedure is, however, not the only possible implementation of $\mathcal{R}$. One could also, for example, use high-order FIR approximations of the elements in $\mathcal{R}$. Such an FIR approximation can be obtained by using a unit pulse, δ(t), as input signal and record a series of samples at the N outputs of the filter. The recorded N output signals then constitute the impulse responses of the elements of $\mathcal{R}$, and the FIR filter coefficients are obtained by truncating the output signals at an appropriate length.

It should be noted that if no individual phase compensation is performed on each one of the N loudspeakers, then $\check{B}_{0*}=\check{B}_{0*}$ and $\tilde{B}(q^{-1})=\check{B}_0(q^{-1})+\Delta B(q^{-1})\check{B}_1(q^{-1})$. If, on the other hand, no model uncertainty is used in the design, then the third right hand term of (21) will vanish and $\tilde{B}(q^{-1})=B(q^{-1})\tilde{A}(q^{-1})F_*(q)$. Finally, if neither model uncertainties, nor any individual phase compensation on the N loudspeakers is used, then $\tilde{B}(q^{-1})=B$.

In a practical controller design, the third term on the right hand side of (21) is readily obtained by evaluating, see [26, 27, 32], $$\tilde{E}\{\Delta B_*V_*V\Delta B\}_{(i,j)}=tr\ V_*V\tilde{E}\{\Delta B_{(:,j)}\Delta B_{(:,i)*}\}. \tag{25}$$

Now recall that the random coefficients of the individual polynomial elements of ΔB are specified as a zero mean, unit variance white noise sequences, implying that $\tilde{E}\{\Delta B_{(i,j)}\Delta B_{(i,j)*}\}=1$. Furthermore, it is assumed that these random coefficients are uncorrelated between different columns of ΔB, i.e., $\tilde{E}\{\Delta B_{(i,j)}\Delta B_{(m,n)*}\}=0$ for j≠n, since reverberation fields belonging to separate sources are, in general, spatially uncorrelated. We therefore know, firstly, that the M|M-dimensional polynomial matrix $\tilde{E}\{\Delta B_{(:,j)}\Delta B_{(:,j)*}\}$ contains ones along its diagonal and, secondly, that $\tilde{E}\{\Delta B_{(:,j)}\Delta B_{(:,i)*}\}=0_M$ if i≠j. Moreover, if the polynomial matrix $V_*V$ is diagonal, then we obtain $$\bar{E}\{\Delta B_*V_*V\Delta B\}_{(i,j)}=\begin{cases} tr\ V_*V & \text{if } i=j \\ 0 & \text{if } i\neq j. \end{cases} \tag{26}$$

and thus the expression for $\tilde{E}\{\Delta B_*V_*V\Delta B\}$ in (21) becomes $$\tilde{E}\{\Delta B_*V_*V\Delta B\}=I_N tr\ V_*V. \tag{27}$$

An important insight here is that, due to the diagonal structure of the error weight $V_*V$ and the trace operator appearing in (25), the off-diagonal elements of $\tilde{E}\{\Delta B_{(:,j)}\Delta B_{(:,i)*}\}$ will not contribute to the filter design. Since these off-diagonal elements constitute the "spatial covariances" $\tilde{E}\{(\Delta B_{(i,j)}\Delta B_{(m,n)*}\}$, with i≠m, we conclude that spatial covariances in the uncertainty model, will be superfluous for the type of filter design studied here. The off-diagonal elements of $\tilde{E}\{\Delta B_*V_*V\Delta B\}$ can however be used in the design by selecting the off-diagonal elements of $V_*V$ different from zero. For example, these off-diagonal elements can be used to downgrade the importance of peripherial measurement points in the design compared with the central ones.

Post-Processing for a Balanced Magnitude Spectrum

When a sound system is reproducing music, it is mostly preferable that the magnitude spectrum of the system's transfer functions is smooth and well balanced, at least on average over the listening region. If the compensated system perfectly attains the desired target $\mathcal{D}$ at all positions, then the average magnitude response of the compensated system will be equal to that of the target. However, since the designed controller $\mathcal{R}$ cannot be expected to fully reach the target response $\mathcal{D}$ at all frequencies, e.g., due to very complex room reverberation that cannot be fully compensated for, there will always be some remaining approximation errors in the compensated system. These approximation errors may have different magnitude at different frequencies, and they may affect the quality of the reproduced sound. Magnitude response imperfections are generally undesirable and the controller matrix should preferably be adjusted so that an overall target magnitude response is reached on average in all the listening regions.

A final design step is therefore preferably added after the criterion minimization with the aim of adjusting the controller response so that, on average, a target magnitude response is well approximated on average over the measurement positions. To this end, the magnitude responses of the overall system (i.e., the system including the controller $\mathcal{R}$) can be evaluated in the various listening positions, based on the design models or based on new measurements. A minimum phase filter can then be designed so that on average (in the RMS sense) the target magnitude response is reached in all listening regions. As an example, variable fractional octave smoothing based on the spatial response variations may be employed in order not to overcompensate in any particular frequency region. The result is one scalar equalizer filter that adjusts all the elements of $\mathcal{R}$ by an equal amount.

An Illustrative Example

Figure 6:
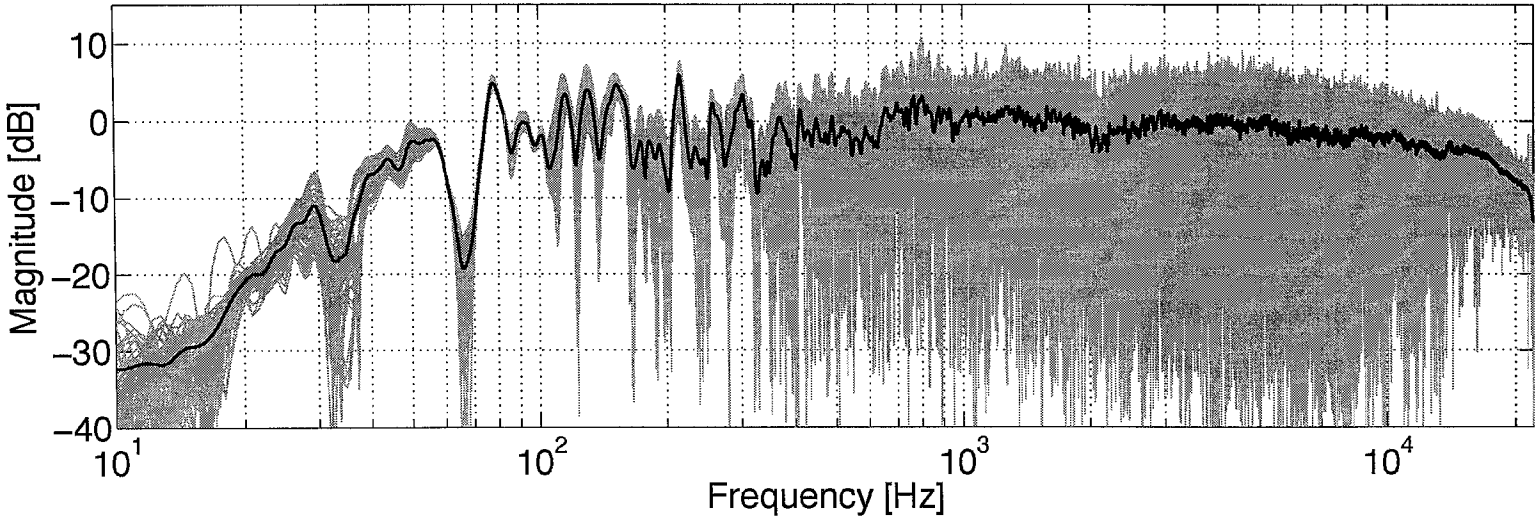
FIG. 6 is the frequency responses of a loudspeaker in a room, measured at 64 positions (grey lines) and their root-mean-square (RMS) average (black line).
Figure 7:
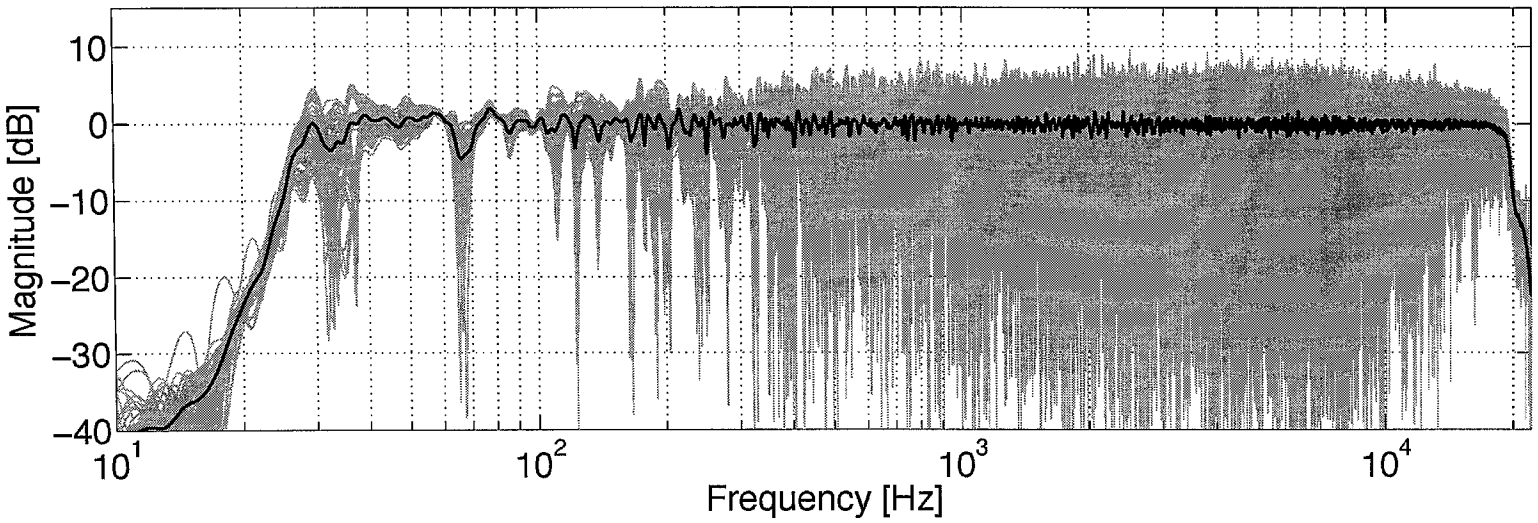
FIG. 7 is the frequency responses of the same loudspeaker as in FIG. 6, after a single-channel precompensation filter has been applied to its input. The figure shows the frequency responses measured at 64 positions (grey lines) and their root-mean-square (RMS) average (black line).
Figure 8:
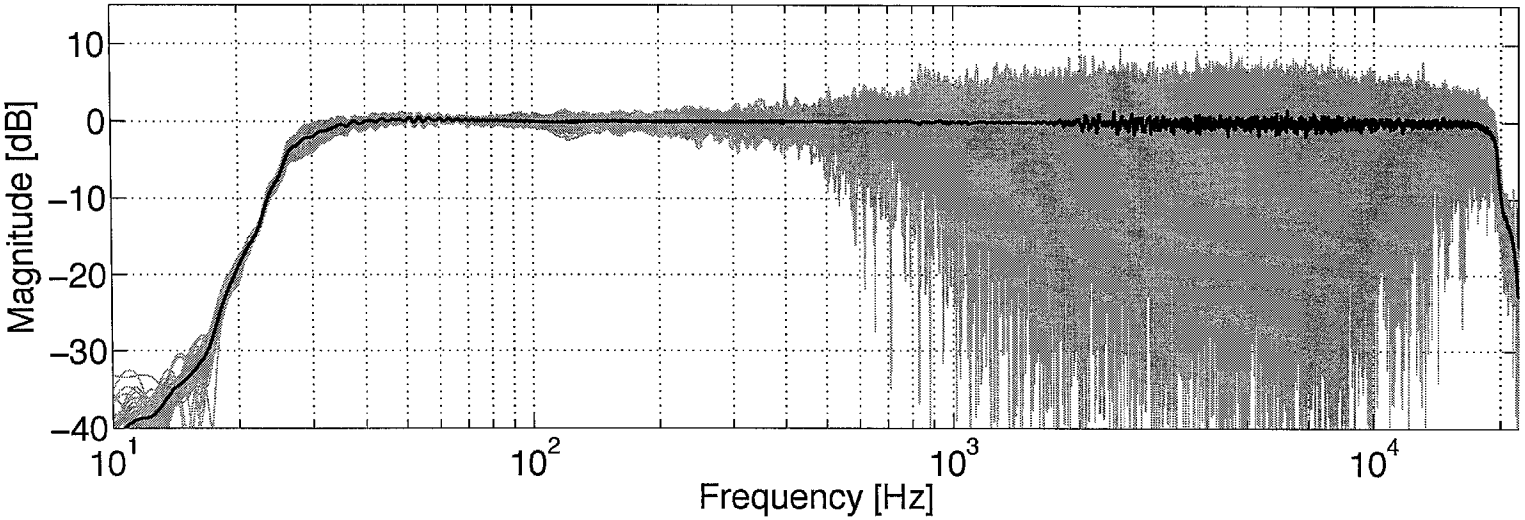
FIG. 8 shows the result of a multichannel precompensation, where the loudspeaker of FIG. 6 was used as primary loudspeaker, and an additional 15 loudspeakers were used as support loudspeakers. The figure shows the frequency responses measured at 64 positions (grey lines) and their root-mean-square (RMS) average (black line).
Figure 9:
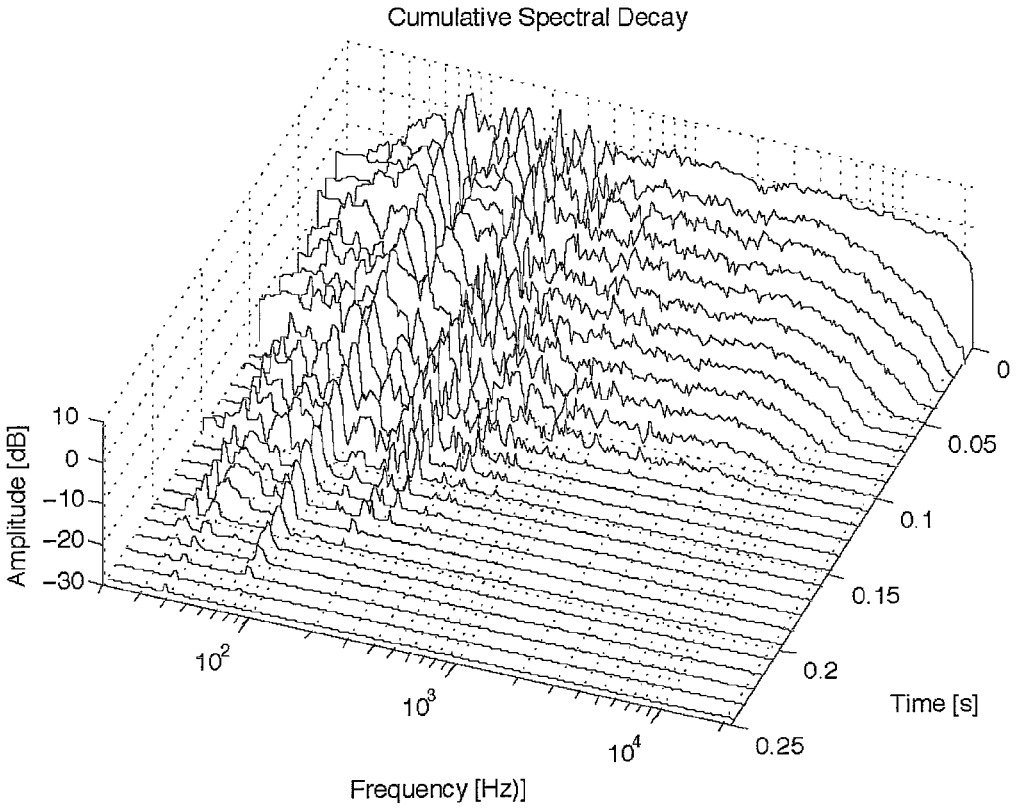
FIG. 9 shows a waterfall plot, or cumulative spectral decay, of the same loudspeaker as in FIG. 6, when no precompensation has been applied. The waterfall shown in the figure is the average cumulative spectral decay of the loudspeaker's impulse response in 64 positions.
Figure 10:
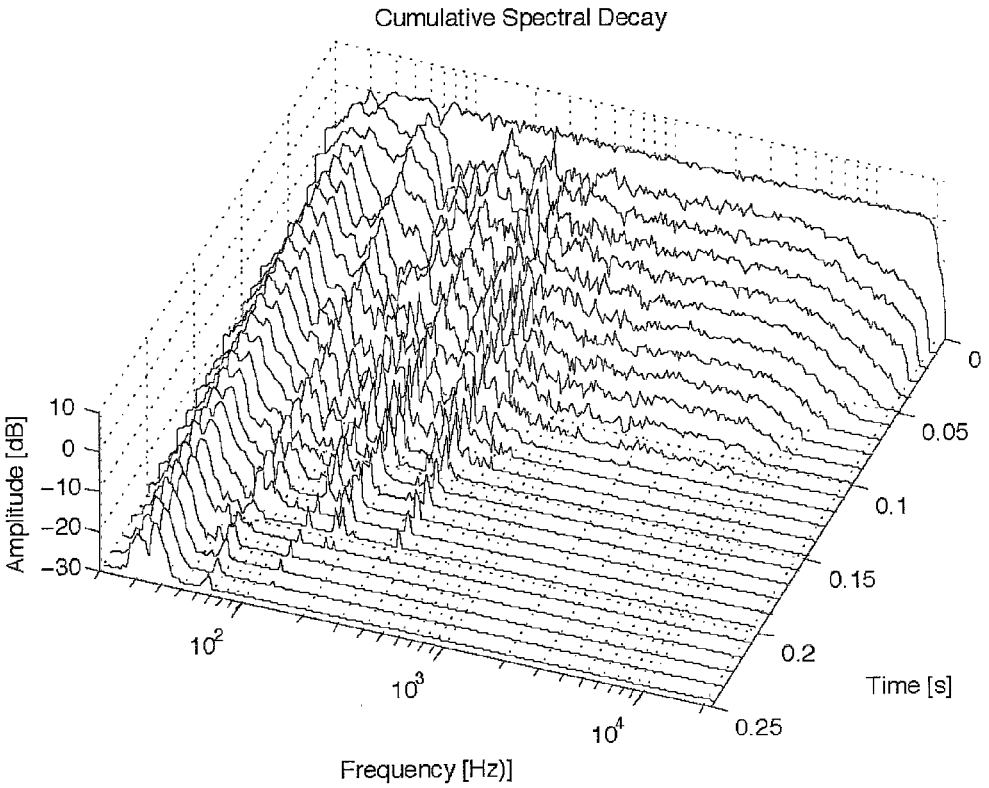
FIG. 10 shows a waterfall plot, or cumulative spectral decay, of the same loudspeaker as in FIG. 7, where a single-channel precompensation filter has been applied. The waterfall shown in the figure is the average cumulative spectral decay of the compensated loudspeaker's impulse response in 64 positions.
Figure 11:
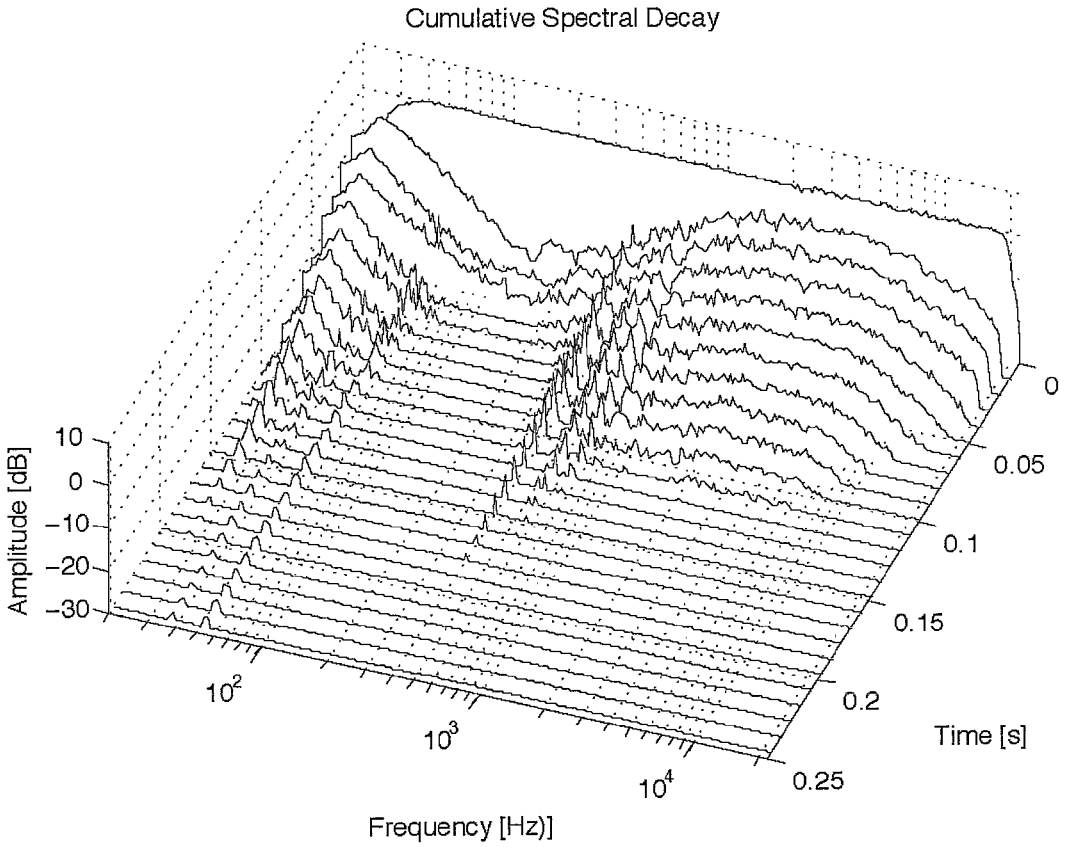
FIG. 11 shows a waterfall plot, or cumulative spectral decay, of the same loudspeaker as in FIG. 8, where a multichannel precompensation strategy has been applied to compensate the primary loudspeaker using 15 additional support loudspeakers. The waterfall shown in the figure is the average cumulative spectral decay of the compensated loudspeaker's impulse response in 64 positions.

An example of the performance of the suggested precompensator design, and its difference from a traditional single-channel design is shown in FIG. 6-11:

- FIG. 6 and FIG. 9 show the frequency responses and average cumulative spectral decay ("waterfall plot"), respectively, of an ATC SCM16 studio monitor loudspeaker, measured at 64 positions in a room.
- FIG. 7 and FIG. 10 show the frequency responses and average waterfall plot respectively, of the same loudspeaker after a single-channel precompensator has been applied to the input of the loudspeaker.
- FIG. 8 and FIG. 11 show the frequency responses and average waterfall plot when the new multichannel design method has been applied. The objective of the compensator design was here the same as for the single-channel design of FIG. 7 and FIG. 10, i.e., the single loudspeaker of the previous figures was used as primary loudspeaker and the aim was to make the response of this primary loudspeaker as ideal as possible. In order to better reach the target, an additional 15 loudspeakers were used as support loudspeakers. The support loudspeakers were surrounding the listening region where the measurements were taken, and they were positioned at various heights and at various distances from the listening region.

Filter Implementation

The resulting filter $\mathcal{R}$ of (20) can be realized in any number of ways, in state space form or in transfer function form. The required filters are in general of very high order, in particular if a full audio range sampling rate is used and if also room acoustic dynamics have been taken into account in the model on which the design is based. To obtain a computationally feasible design, methods for limiting the computational complexity of the precompensator are of interest. We here outline one method for this purpose that is based on controller order reduction of elements of the controller matrix $\mathcal{R}$, in particular of any transfer functions that have impulse responses with very long but smooth tails. The method works as follows.

The relevant scalar impulse response elements $\mathcal{R}_1, \ldots, \mathcal{R}_N$ of the pre-compensator $\mathcal{R}$ are first represented as very long FIR filters, as mentioned above. Then, for each precompensator impulse response $\mathcal{R}_j$, do the following:

1. Determine a lag $t_1>1$ after which the impulse response is approximately exponentially decaying and has a smooth shape, and a second lag $t_2>t_1$ after which the impulse response coefficients are negligible.
2. Use a model reduction or system identification technique to adjust a low-order recursive IIR filter to approximate the FIR filter tail for a delay interval $[t_1, t_2]$
3. Realize the approximated scalar precompensator filter as a parallel connection $\mathcal{R}_j(q^{-1})=M(q^{-1})+q^{-t_1}N(q^{-1})$, where $M(q^{-1})$ is a FIR filter that equals the first $t_1$ impulse response coefficients of the original FIR filter $\mathcal{R}_j(q^{-1})$, from lag zero to lag $t_1-1$, while $N(q^{-1})$ is the IIR filter that approximates it tail.

The aim of this procedure is to obtain realizations in which the sum of the number of parameters in the FIR filter $M(q^{-1})$ and the IIR filter $N(q^{-1})$ is much lower than the original number of impulse response coefficients. Various different methods for approximating the tail of the impulse response can be used, for example adjustment of autoregressive models to a covariance sequence based on the Yule-Walker equations. To obtain low numerical sensitivity to rounding errors of coefficients when implementing the resulting IIR filters with finite precision arithmetic, it is preferable to implement them as parallel connections or series connections of lower order filters. As an example, first order filters or second order IIR filter elements (so-called biquadratic filters) may be used.

Implementational Aspects

Typically, the design methodology is executed on a computer system to produce the filter parameters of the precompensation filter. The calculated filter parameters are then normally downloaded to a digital filter, for example realized by a digital signal processing system or similar computer system, which executes the actual filtering.

Although the invention can be implemented in software, hardware, firmware or any combination thereof, the filter design scheme proposed by the invention is preferably implemented as software in the form of program modules, functions or equivalent. The software may be written in any type of computer language, such as C, C++ or even specialized languages for digital signal processors (DSPs). In practice, the relevant steps, functions and actions of the invention are mapped into a computer program, which when being executed by the computer system effectuates the calculations associated with the design of the precompensation filter. In the case of a PC-based system, the computer program used for the design or determination of the audio precompensation filter is normally encoded on a computer-readable medium such as a DVD, CD or similar structure for distribution to the user/filter designer, who then may load the program into his/her computer system for subsequent execution. The software may even be downloaded from a remote server via the Internet.

There is thus provided a system, and corresponding computer program product, for determining an audio precompensation controller for an associated sound generating system comprising a total of $N\geq 2$ loudspeakers, each having a loudspeaker input, where the audio precompensation controller has a number $L\geq 1$ inputs for L input signal(s) and N outputs for N controller output signals, one to each loudspeaker of the sound generating system. Keeping in mind that the audio precompensation controller has a number of adjustable filter parameters to be determined. The system basically comprises means for estimating, for each one of at least a subset of the N loudspeaker inputs, an impulse response at each of a plurality $M\geq 2$ of measurement positions, distributed in a region of interest in a listening environment, based on sound measurements at the M measurement positions. The system also comprises means for specifying, for each one of the L input signal(s), a selected one of the N loudspeakers as a primary loudspeaker and a selected subset S including at least one of the N loudspeakers as support loudspeaker(s), where the primary loudspeaker is not part of the subset. The system further comprises means for specifying, for each primary loudspeaker, a target impulse response at each of the M measurement positions with the target impulse response having an acoustic propagation delay, where the acoustic propagation delay is determined based on the distance from the primary loudspeaker to the respective measurement position. The system also comprises means for determining, for each one of the L input signal(s), based on the selected primary loudspeaker and the selected support loudspeaker(s), filter parameters of the audio precompensation controller so that a criterion function is optimized under the constraint of stability of the dynamics of the audio precompensation controller. The criterion function is defined to include a weighted summation of powers of differences between the compensated estimated impulse responses and the target impulse responses over the M measurement positions.

For the case where L≥2, the system may also include means for merging all of the filter parameters, determined for the L controller input signals, into a merged set of filter parameters for the audio precompensation controller. The audio precompensation controller, with the merged set of filter parameters, is then configured for operating on the L input signals to generate the N controller output signals to the loudspeakers to attain the desired target impulse responses.

In a particular example, the means for determining filter parameters of the audio precompensation controller is configured to operate based on a Linear Quadratic Gaussian (LQG) optimization of the parameters of a stable, linear and causal multivariable feedforward controller based on a given target dynamical system, and a dynamical model of the sound generating system.

The computer program product comprises corresponding program means, and is configured for determining the audio precompensation controller when running on a computer system.

Figure 4:
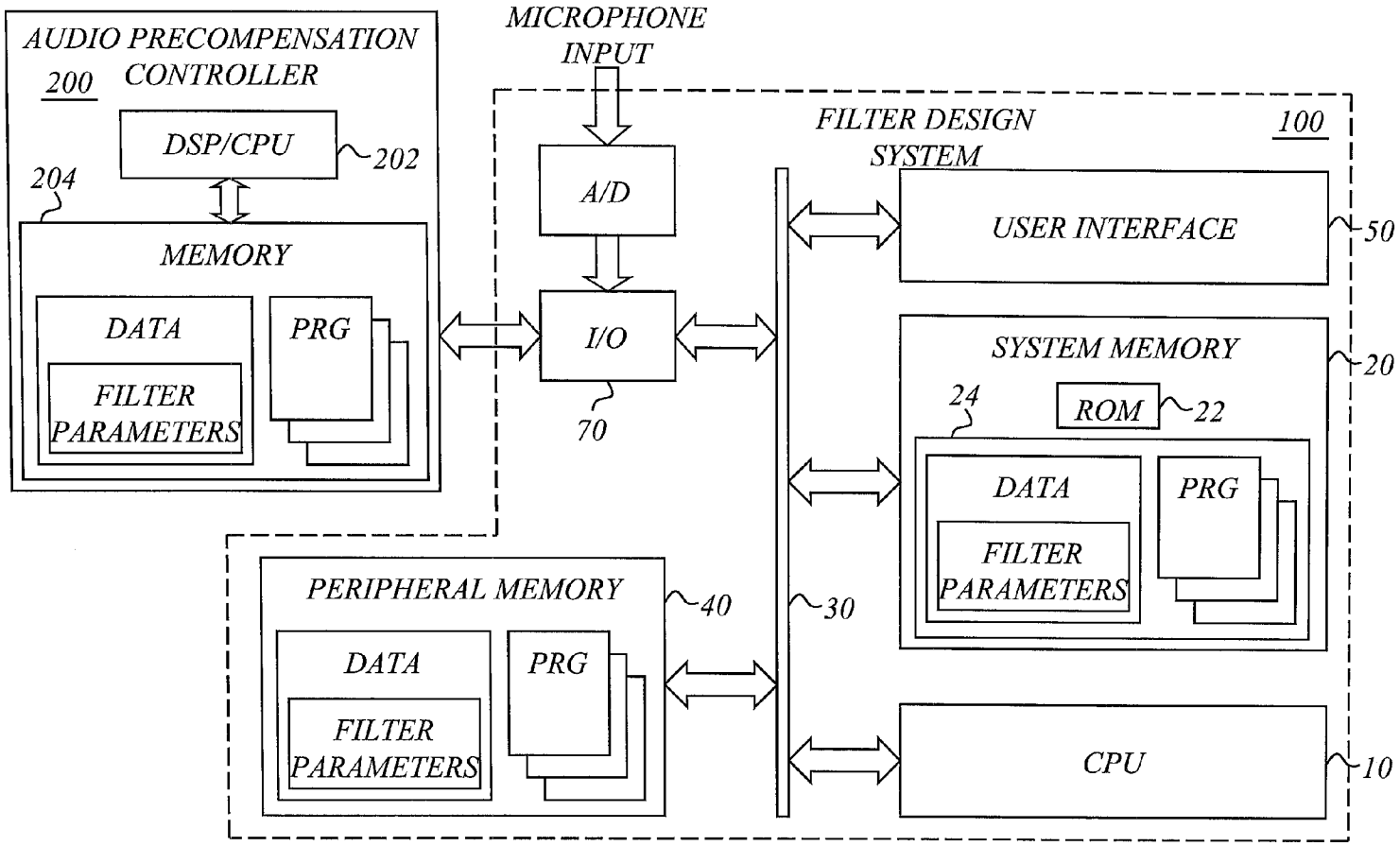
FIG. 4 is a schematic block diagram of an example of a computer-based system suitable for implementation of the invention.

FIG. 4 is a schematic block diagram illustrating an example of a computer system suitable for implementation of a filter design algorithm according to the invention. The filter design system 100 may be realized in the form of any conventional computer system, including personal computers (PCs), mainframe computers, multiprocessor systems, network PCs, digital signal processors (DSPs), and the like. Anyway, the system 100 basically comprises a central processing unit (CPU) or digital signal processor (DSP) core 10, a system memory 20 and a system bus 30 that interconnects the various system components. The system memory 20 typically includes a read only memory (ROM) 22 and a random access memory (RAM) 24. Furthermore, the system 100 normally comprises one or more driver-controlled peripheral memory devices 40, such as hard disks, magnetic disks, optical disks, floppy disks, digital video disks or memory cards, providing non-volatile storage of data and program information. Each peripheral memory device 40 is normally associated with a memory drive for controlling the memory device as well as a drive interface (not illustrated) for connecting the memory device 40 to the system bus 30. A filter design program implementing a design algorithm according to the invention, possibly together with other relevant program modules, may be stored in the peripheral memory 40 and loaded into the RAM 24 of the system memory 20 for execution by the CPU 10. Given the relevant input data, such as measurements, input specifications, and possibly a model representation and other optional configurations, the filter design program calculates the filter parameters of the audio precompensation controller/filter.

The determined filter parameters are then normally transferred from the RAM 24 in the system memory 20 via an I/O interface 70 of the system 100 to an audio precompensation controller 200. Preferably, the audio precompensation controller 200 is based on a digital signal processor (DSP) or similar central processing unit (CPU) 202, and one or more memory modules 204 for holding the filter parameters and the required delayed signal samples. The memory 204 normally also includes a filtering program, which when executed by the processor 202, performs the actual filtering based on the filter parameters.

Instead of transferring the calculated filter parameters directly to the audio precompensation controller 200 via the I/O system 70, the filter parameters may be stored on a peripheral memory card or memory disk 40 for later distribution to an audio precompensation controller, which may or may not be remotely located from the filter design system 100. The calculated filter parameters may also be downloaded from a remote location, e.g. via the Internet, and then preferably in encrypted form.

In order to enable measurements of sound produced by the audio equipment under consideration, any conventional microphone unit(s) or similar recording equipment may be connected to the computer system 100, typically via an analog-to-digital (A/D) converter. Based on measurements of (conventional) audio test signals made by the microphone unit, the system 100 can develop a model of the audio system, using an application program loaded into the system memory 20. The measurements may also be used to evaluate the performance of the combined system of precompensation filter and audio equipment. If the designer is not satisfied with the resulting design, he may initiate a new optimization of the precompensation filter based on a modified set of design parameters.

Furthermore, the system 100 typically has a user interface 50 for allowing user-interaction with the filter designer. Several different user-interaction scenarios are possible.

For example, the filter designer may decide that he/she wants to use a specific, customized set of design parameters in the calculation of the filter parameters of the audio precompensation controller 200. The filter designer then defines the relevant design parameters via the user interface 50.

It is also possible for the filter designer to select between a set of different pre-configured parameters, which may have been designed for different audio systems, listening environments and/or for the purpose of introducing special characteristics into the resulting sound. In such a case, the preconfigured options are normally stored in the peripheral memory 40 and loaded into the system memory during execution of the filter design program.

The filter designer may also define a reference system by using the user interface 50. Instead of determining a system model based on microphone measurements, it is also possible for the filter designer to select a model of the audio system from a set of different preconfigured system models. Preferably, such a selection is based on the particular audio equipment with which the resulting precompensation filter is to be used. Another option is to design a set of filters for a selected appropriate set of weighting matrices to be able to vary the degree of support provided by the selected set of support loudspeakers.

Preferably, the audio filter is embodied together with the sound generating system so as to enable reproduction of sound influenced by the filter.

In an alternative implementation, the filter design is performed more or less autonomously with no or only marginal user participation. An example of such a construction will now be described. The exemplary system comprises a supervisory program, system identification software and filter design software. Preferably, the supervisory program first generates test signals and measures the resulting acoustic response of the audio system. Based on the test signals and the obtained measurements, the system identification software determines a model of the audio system. The supervisory program then gathers and/or generates the required design parameters and forwards these design parameters to the filter design program, which calculates the audio precompensation filter parameters. The supervisory program may then, as an option, evaluate the performance of the resulting design on the measured signal and, if necessary, order the filter design program to determine a new set of filter parameters based on a modified set of design parameters. This procedure may be repeated until a satisfactory result is obtained. Then, the final set of filter parameters are downloaded/implemented into the audio precompensation controller.

It is also possible to adjust the filter parameters of the precompensation filter adaptively, instead of using a fixed set of filter parameters. During the use of the filter in an audio system, the audio conditions may change. For example, the position of the loudspeakers and/or objects such as furniture in the listening environment may change, which in turn may affect the room acoustics, and/or some equipment in the audio system may be exchanged by some other equipment leading to different characteristics of the overall audio system. In such a case, continuous or intermittent measurements of the sound from the audio system in one or several positions in the listening environment may be performed by one or more microphone units, possibly wirelessly connected, or similar sound recording equipment. The recorded sound data may then be fed, possibly wirelessly, into a filter design system, which calculates a new audio system model and adjusts the filter parameters so that they are better adapted for the new audio conditions.

Naturally, the invention is not limited to the arrangement of FIG. 4. As an alternative, the design of the precompensation filter and the actual implementation of the filter may both be performed in one and the same computer system 100 or 200. This generally means that the filter design program and the filtering program are implemented and executed on the same DSP or microprocessor system.

The audio precompensation controller may be realized as a standalone equipment in a digital signal processor or computer that has an analog or digital interface to the subsequent amplifiers, as mentioned above. Alternatively, it may be integrated into the construction of a digital preamplifier, a car audio system, a cinema theatre audio system, a concert hall audio system, a computer sound card, a compact stereo system, a home audio system, a computer game console, a TV, a docking station for an MP3 player, a soundbar or any other device or system aimed at producing sound. It is also possible to realize the precompensation filter in a more hardware-oriented manner, with customized computational hardware structures, such as FPGAs or ASICs.

In a particular example, the audio precompensation controller is implemented as a linear stable causal feedforward controller.

It should be understood that the precompensation may be performed separate from the distribution of the sound signal to the actual place of reproduction. The precompensation signal generated by the precompensation filter does not necessarily have to be distributed immediately to and in direct connection with the sound generating system, but may be recorded on a separate medium for later distribution to the sound generating system. The compensation signal could then represent for example recorded music on a CD or DVD disk that has been adjusted to a particular audio equipment and listening environment. It can also be a precompensated audio file stored on an Internet server for allowing subsequent downloading of the file to a remote location over the Internet.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

REFERENCES

[1] B. D. O. Anderson and J. B. Moore. *Optimal Control, Linear Quadratic Methods*. Prentice-Hall, Englewood Cliffs, N.J., 1990.

[2] J. Bauck and D. H. Cooper. Generalized transaural stereo and applications. *Journal of the Audio Engineering Society,* 44(9):683-705, September 1996.

[3] S. Bharitkar and C. Kyriakakis. Phase equalization for multi-channel loudspeaker-room responses. U.S. Pat. No. 7,720,237.

[4] L.-J. Brännmark. Robust audio precompensation with probabilistic modeling of transfer function variability. In *IEEE Workshop on Applications of Signal Processing to Audio and Acoustics, WASPAA '09, Proceedings*, pages 193-196, New Paltz, N.Y., October 2009.

[5] L.-J. Brtinnmark and A. Ahlén. Spatially robust audio compensation based on SIMO feed-forward control. *IEEE Transactions on Signal Processing,* 57(5), May 2009.

[6] L.-J. Brinnmark, M. Sternad, and A. Ahlén. Spatially robust audio precompensation. European Patent EP 2 104 374.

[7] A. Celestinos and S. Birkedal Nielsen. Time based room correction system for low frequencies using multiple loudspeakers. Presented at the AES 32nd International Conference: DSP for Loudspeakers, September 2007.

[8] A. Celestinos and S. Birkedal Nielsen. Controlled acoustic bass system (CABS) A method to achieve uniform sound field distribution at low frequencies in rectangular rooms. *J. Audio Eng. Soc,* 56(11):915-931, 2008.

[9] E. Corteel. Equalization in an extended area using multichannel equalization and wave field synthesis. *Journal of the Audio Engineering Society,* 54(12): 1140-1161, December 2006.

[10] J. Daniel, R. Nicol, and S. Moreau. Further investigations of high order ambisonics and wavefield synthesis for holophonic sound imaging. Presented at AES114th Convention, Amsterdam. Preprint 5788. Audio Engineering Society, March 2003.

[11] S. J. Elliott, I. M. Stothers, and P. A. Nelson. A multiple error LMS algorithm and its application to the active control of sound and vibration. *IEEE Transactions on Acoustics, Speech and Signal Processing,* 35(10):1423-1434, October 1987.

[12] F. M. Fazi, P. A. Nelson, J. E. N. Christensen, and J. Seo. Surround system based on three dimensional sound field reconstruction. Presented at AES125th Convention, San Francisco. Preprint 7555. Audio Engineering Society, October 2008.

[13] L. D. Fielder. Analysis of traditional and reverberation-reducing methods of room equalization. *Journal of the Audio Engineering Society,* 51(1/2):3-26, January/February 2004.

[14] P. Hatziantoniou and J. Mourjopoulos. Errors in real-time room acoustics dereverberation. *Journal of the Audio Engineering Society,* 52(9):883-899, September 2004.

[15] T. Kailath. Linear Systems. Prentice-Hall, Englewood Cliffs, N.J., 1980.

[16] M. Kajalainen, A. Mäkivirta, P. Antsalo, and V. Välimäki. Method for designing a modal equalizer for a low frequency sound reproduction. U.S. Pat. No. 7,742,607.

[17] M. Karjalainen, T. Paatero, J. Mourjopoulos, and P. Hatziantoniou. About room response equalization and dereverberation. In *IEEE Workshop on Applications of Signal Processing to Audio and Acoustics, WASPAA '05, Proceedings*, pages 183-186, New Paltz, N.Y., October 2005.

[18] M. Kolundžija, C. Faller, and M. Vetterli. Reproducing sound fields using MIMO acoustic channel inversion. *Journal of the Audio Engineering Society,* 59(10):721-734, October 2011.

[19] V. Kučera. *Analysis and Design of Discrete Linear Control Systems*. Academia, Prague, 1991.

[20] H. Kwakernaak and R. Sivan. *Linear Optimal Control Systems*. Wiley, New York, 1972.

[21] A. Mäkivirta, P. Antsalo, M. Karjalainen, and V. Välimäki. Modal equalization of loudspeaker-room responses at low frequencies. *J. Audio Eng. Soc,* 51(5): 324-343, 2003.

[22] M. Miyoshi and Y. Kaneda. Inverse filtering of room acoustics. *IEEE Transactions on Acoustics, Speech and Signal Processing,* 36(2):145-152, February 1988.

[23] S. T. Neely and J. B. Allen. Invertibility of a room impulse response. *The Journal of the Acoustical Society of America,* 66(1):165-169, July 1979.

[24] P. A. Nelson, O. Kirkeby, and T. Takeuchi. Sound fields for the production of virtual acoustic images. *Journal of Sound and Vibration,* 204(2):386-396, July 1997.

[25] P. A. Nelson, F. Orduñ a-Bustamante, D. Engler, and H. Hamada. Experiments on a system for the synthesis of virtual acoustic sources. *Journal of the Audio Engineering Society,* 44(11):990-1007, November 1996.

[26] K. Öhrn. *Design of Multivariable Cautious Discrete-Time Wiener Filters: A Probabilistic Approach*. PhD thesis, Uppsala University, Sweden, 1996.

[27] K. Öhrn, A. Ahlén, and M. Sternad. A probabilistic approach to multivariable robust filtering and open-loop control. *IEEE Transactions on Automatic Control,* 40(3): 405-418, March 1995.

[28] M. A. Poletti. Three-dimensional surround sound systems based on spherical harmonics. *Journal of the Audio Engineering Society,* 53(11): 1004-1025, November 2005.

[29] S. Spors, H. Buchner, R. Rabenstein, and W. Herbordt. Active listening room compensation for massive multichannel sound reproduction systems using wave-domain adaptive filtering. *The Journal of the Acoustical Society of America,* 122(1):354-369, July 2007.

[30] S. Spors, R. Rabenstein, and J. Ahrens. The theory of wave field synthesis revisited. Presented at AES124th Convention, Amsterdam. Preprint 7358. Audio Engineering Society, May 2008.

[31] M. Sternad and A. Ahlén. LQ controller design and self-tuning control. In K. Hunt, editor, *Polynomial Methods in Optimal Control and Filtering*, pages 56-92. Peter Peregrinus, London, UK, 1993.

[32] M. Sternad and A. Ahlén. Robust filtering and feedforward control based on probabilistic descriptions of model errors. *Automatica,* 29(3):661-679, 1993.

[33] J. Vanderkooy. Multi-source room equalization: Reducing room resonances. Presented at AES123rd Convention, New York. Preprint 7262. Audio Engineering Society, October 2007.

[34] T. Welti and A. Devantier. Low-frequency optimization using multiple subwoofers. *J. Audio Eng. Soc,* 54(5):347-364, 2006.

The invention claimed is:

1. A method for determining an audio physical precompensation controller for an associated sound generating system comprising a total of N≥2 loudspeakers, each having a loudspeaker input, said audio precompensation controller having a number L≥1 inputs for L input signal(s) and N outputs for N controller output signals, one to each loudspeaker of said sound generating system, said audio precompensation controller having a number of adjustable filter parameters, with said method comprising the steps of:

estimating, for each one of at least a subset of said N loudspeaker inputs, an impulse response at each of a plurality M≥2 of measurement positions, distributed in a region of interest in a listening environment, based on sound measurements at said M measurement positions;

specifying, for each one of said L input signal(s), a selected one of said N loudspeakers as a primary loudspeaker and a selected subset S including at least one of said N loudspeakers as additional loudspeaker(s), henceforth called support loudspeaker(s), for improving the performance of the primary loudspeaker, where said primary loudspeaker is not part of said subset, wherein the sound generating system is represented, for each one of said L input signal(s), by a transfer function matrix $\mathcal{H}$ having 1+S columns, in which each column represents the impulse responses of one of the loudspeakers at said M measurement positions, and one of the columns includes the responses of the primary loudspeaker and the rest of the columns includes the responses of the S selected support loudspeakers;

specifying, for each primary loudspeaker, a target impulse response at each of said M measurement positions represented by a reference matrix or vector $\mathcal{D}$, with said target impulse response having an acoustic propagation delay, where said acoustic propagation delay is determined based on the distance from the primary loudspeaker to the respective measurement position; and determining, for each one of said L input signal(s), based on the selected primary loudspeaker and the selected support loudspeaker(s), filter parameters of said audio precompensation controller, represented by $\mathcal{R}$, having an input and 1+S outputs depending on the number S of selected support loudspeakers, so that a criterion function is optimized under the constraint of stability of the dynamics of said audio precompensation controller, with said criterion function including a weighted summation of powers of differences between the compensated estimated impulse responses represented by $\mathcal{H}\mathcal{R}$ and the target impulse responses represented by $\mathcal{D}$ over said M measurement positions, wherein the differences are represented by $(\mathcal{D}-\mathcal{H}\mathcal{R})w(t)$, where w(t) represents the considered one of said L input signals.

2. The method of claim 1, wherein L≥2, and said method comprises the step of merging all of said filter parameters, determined for said L input signals, into a merged set of filter parameters for said audio precompensation controller, wherein said audio precompensation controller with said merged set of filter parameters is configured for operating on said L input signals to generate said N controller output signals to said loudspeakers to attain said target impulse responses.

3. The method of claim 1, wherein said audio precompensation controller is configured for controlling the acoustic response of P primary loudspeakers, where $P \leq L$ and $P \leq N$, by the combined use of said P primary loudspeakers and, for each primary loudspeaker, an additional number of support loudspeakers $1 \leq S \leq N-1$ of said N loudspeakers.

4. The method of claim 1, wherein said audio precompensation controller has the ability of producing output zero to some of said N loudspeakers for some setting of its adjustable filter parameters.

5. The method of claim 1, wherein said step of determining filter parameters of said audio precompensation controller is based on a Linear Quadratic Gaussian (LQG) optimization of the parameters of a stable, linear and causal multivariable feedforward controller based on a given target dynamical system, and a dynamical model of the sound generating system.

6. The method of claim 1, wherein each one of said N controller output signals of said audio precompensation controller is fed to a respective loudspeaker via an all-pass filter including a phase compensation component and a delay component, yielding N filtered controller output signals.

7. The method of claim 1, wherein said criterion function includes penalty terms, with said penalty terms being such that said audio precompensation controller, obtained by optimizing said criterion function, produces signal levels of constrained magnitude on a selected subset of said precompensation controller outputs, yielding constrained signal levels on selected loudspeaker inputs to said N loudspeakers for specified frequency bands.

8. The method of claim 7, wherein said penalty terms are differently chosen a number of times and said step of determining filter parameters of said audio precompensation controller is repeated for each choice of said penalty terms, resulting in a number of instances of said audio precompensation controller, each of which produces signal levels with individually constrained magnitudes to said S support loudspeakers for specified frequency bands.

9. The method of claim 1, wherein said criterion function includes, firstly, a set of models describing a range of possible errors in the estimated impulse responses, and secondly, an aggregation operation, where said aggregation operation is a sum, a weighted sum or a statistical expectation over said set of models.

10. The method of claim 1, wherein said step of determining filter parameters of said audio precompensation controller is also based on adjusting filter parameters of said audio precompensation controller to reach a target magnitude frequency response of said sound generating system including said audio precompensation controller, in at least a subset of said M measurement positions.

11. The method of claim 10, wherein said step of adjusting filter parameters of said audio precompensation controller is based on the evaluation of magnitude frequency responses in at least a subset of said M measurement positions and thereafter determining a minimum phase model of said sound generating system including said audio precompensation controller.

12. The method of claim 1, where the target impulse responses are nonzero and include adjustable parameters that can be modified within prescribed limits.

13. The method of claim 12, where the adjustable parameters of the target impulse responses, as well as the adjustable parameters of the audio precompensation controller, are adjusted jointly, with the aim of optimizing said criterion function.

14. The method of claim 1, wherein said step of estimating, for each one of at least a subset of said N loudspeaker inputs, an impulse response at each of a plurality M of measurement positions is based on a model describing the dynamical response of said sound generating system at said M measurement positions.

15. The method of claim 1, wherein said audio precompensation controller is created by implementing said filter parameters in an audio filter structure.

16. The method of claim 15, wherein said audio filter structure is embodied together with said sound generating system to enable generation of said target impulse response at said M measurement positions in said listening environment.

17. The method of claim 1, wherein said sound generating system is a car audio system or mobile studio audio system and said listening environment is part of a car or a mobile studio.

18. The method of claim 1, wherein said sound generating system is a cinema theatre audio system, concert hall audio system, home audio system, or a professional audio system and said listening environment is part of a cinema theatre, a concert hall, a home, a studio, an auditorium, or any other premises.

19. An audio precompensation controller determined by using the method of claim 1.

20. The audio precompensation controller of claim 19, wherein said audio precompensation controller is a linear stable causal feedforward controller.

21. An audio system comprising a sound generating system and an audio precompensation controller in the input path to said sound generating system, wherein said audio precompensation controller is determined by using the method of claim 1.

22. A system for determining an audio precompensation controller for an associated sound generating system comprising a total of $N \geq 2$ loudspeakers, each having a loudspeaker input, said audio precompensation controller having a number $L \geq 1$ inputs for L input signal(s) and N outputs for N controller output signals, one to each loudspeaker of said sound generating system, said audio precompensation controller having a number of adjustable filter parameters, with said system comprising:

means for estimating, for each one of at least a subset of said N loudspeaker inputs, an impulse response at each of a plurality $M \geq 2$ of measurement positions, distributed in a region of interest in a listening environment, based on sound measurements at said M measurement positions;

means for specifying, for each one of said L input signal(s), a selected one of said N loudspeakers as a primary loudspeaker and a selected subset S including at least one of said N loudspeakers as additional loudspeaker(s), henceforth called support loudspeaker(s), for improving the performance of the primary loudspeaker, where said primary loudspeaker is not part of said subset, wherein the sound generating system is represented, for each one of said L input signal(s), by a transfer function matrix $\mathcal{H}$ having 1+S columns, in which each column represents the impulse responses of one of the loudspeakers at said M measurement positions, and one of the columns includes the responses of the primary loudspeaker and the rest of the columns includes the responses of the S selected support loudspeakers;

means for specifying, for each primary loudspeaker, a target impulse response at each of said M measurement positions represented by a reference matrix or vector $\mathcal{D}$, with said target impulse response having an acoustic propagation delay, where said acoustic propagation delay is determined based on the distance from the primary loudspeaker to the respective measurement position; and means for determining, for each one of said L input signal(s), based on the selected primary loudspeaker and the selected support loudspeaker(s), filter parameters of said audio precompensation controller, represented by $\mathcal{R}$, having an input and 1+S outputs depending on the number S of selected support loudspeakers, so that a criterion function is optimized under the constraint of stability of the dynamics of said audio precompensation controller, with said criterion function including a weighted summation of powers of differences between the compensated estimated impulse responses represented by $\mathcal{H}\mathcal{R}$ and the target impulse responses represented by $\mathcal{D}$ over said M measurement positions, wherein the differences are represented by $(\mathcal{D}-\mathcal{H}\mathcal{R})$w(t), where w(t) represents the considered one of said L input signals.

23. The system of claim 22, wherein L≥2, and said system comprises means for merging all of said filter parameters, determined for said L controller input signals, into a merged set of filter parameters for said audio precompensation controller, wherein said audio precompensation controller with said merged set of filter parameters is configured for operating on said L input signals to generate said N controller output signals to said loudspeakers to attain said target impulse responses.

24. The system of claim 22, wherein said means for determining filter parameters of said audio precompensation controller is configured to operate based on a Linear Quadratic Gaussian (LQG) optimization of the parameters of a stable, linear and causal multivariable feedforward controller based on a given target dynamical system, and a dynamical model of the sound generating system.

25. A computer program product comprising a non-transitory computer-readable medium having encoded thereon a computer program for determining, when running on a computer system, an audio precompensation controller for an associated sound generating system comprising a total of N≥2 loudspeakers, each having a loudspeaker input, said audio precompensation controller having a number L≥1 inputs for L input signal(s) and N outputs for N controller output signals, one to each loudspeaker of said sound generating system, said audio precompensation controller having a number of adjustable filter parameters, wherein said computer program, when executed, causes the computer system to perform the following functions:

estimating, for each one of at least a subset of said N loudspeaker inputs, an impulse response at each of a plurality M≥2 of measurement positions, distributed in a region of interest in a listening environment, based on sound measurements at said M measurement positions;

specifying, for each one of said L input signal(s), a selected one of said N loudspeakers as a primary loudspeaker and a selected subset S including at least one of said N loudspeakers as additional loudspeaker(s), henceforth called support loudspeaker(s), for improving the performance of the primary loudspeaker, where said primary loudspeaker is not part of said subset, wherein the sound generating system is represented, for each one of said L input signal(s), by a transfer function matrix $\mathcal{H}$ having 1+S columns, in which each column represents the impulse responses of one of the loudspeakers at said M measurement positions, and one of the columns includes the responses of the primary loudspeaker and the rest of the columns includes the responses of the S selected support loudspeakers;

specifying, for each primary loudspeaker, a target impulse response at each of said M measurement positions represented by a reference matrix or vector $\mathcal{D}$, with said target impulse response having an acoustic propagation delay, where said acoustic propagation delay is determined based on the distance from the primary loudspeaker to the respective measurement position; and determining, for each one of said L input signal(s), based on the selected primary loudspeaker and the selected support loudspeaker(s), filter parameters of said audio precompensation controller, represented by $\mathcal{R}$, having an input and 1+S outputs depending on the number S of selected support loudspeakers, so that a criterion function is optimized under the constraint of stability of the dynamics of said audio precompensation controller, with said criterion function including a weighted summation of powers of differences between the compensated estimated impulse responses represented by $\mathcal{H}\mathcal{R}$ and the target impulse responses represented by $\mathcal{D}$ over said M measurement positions, wherein the differences are represented by $(\mathcal{D}-\mathcal{H}\mathcal{R})$w(t), where w(t) represents the considered one of said L input signals.

26. The computer program product of claim 25, wherein L≥2, and said computer program, when executed, causes the computer system to perform merging all of said filter parameters, determined for said L input signals, into a merged set of filter parameters for said audio precompensation controller, wherein said audio precompensation controller with said merged set of filter parameters is configured for operating on said L input signals to generate said N controller output signals to said loudspeakers to attain said target impulse responses.

27. The computer program product of claim 25, wherein said computer program, when executed, causes the computer system to operate based on a Linear Quadratic Gaussian (LQG) optimization of the parameters of a stable, linear and causal multivariable feedforward controller based on a given target dynamical system, and a dynamical model of the sound generating system.

* * * * *